US009978323B2

(12) United States Patent
Jin et al.

(10) Patent No.: US 9,978,323 B2
(45) Date of Patent: May 22, 2018

(54) LIQUID CRYSTAL DISPLAY PANEL AND DISPLAY DEVICE

(71) Applicants: Shanghai AVIC OPTO Electronics Co., Ltd., Shanghai (CN); Tianma Micro-Electronics Co., Ltd., Shenzhen (CN)

(72) Inventors: Huijun Jin, Shanghai (CN); Yao Lin, Shanghai (CN)

(73) Assignees: SHANGHAI AVIC OPTOELECTRONICS CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 182 days.

(21) Appl. No.: 14/846,850

(22) Filed: Sep. 7, 2015

(65) Prior Publication Data

US 2016/0180785 A1 Jun. 23, 2016

(30) Foreign Application Priority Data

Dec. 23, 2014 (CN) ..... 2014 1 0835764

(51) Int. Cl.
*G09G 3/36* (2006.01)

(52) U.S. Cl.
CPC ..... *G09G 3/3614* (2013.01); *G09G 2310/021* (2013.01); *G09G 2310/0218* (2013.01); *G09G 2310/0281* (2013.01); *G09G 2310/0283* (2013.01)

(58) Field of Classification Search
CPC ..... G09G 3/3614; G09G 2310/021; G09G 2310/0218; G09G 2310/0281; G09G 2310/0283
USPC .... 345/38, 50, 87–104; 349/77–78, 80, 104, 349/106
See application file for complete search history.

(56) References Cited

U.S. PATENT DOCUMENTS

2004/0207616 A1 10/2004 Iwami et al.
2007/0018930 A1* 1/2007 Do ..... G09G 3/3648 345/96
2007/0097072 A1* 5/2007 Kim ..... G09G 3/3614 345/103
2008/0012842 A1* 1/2008 Mori ..... G09G 3/3677 345/206
2008/0224980 A1 9/2008 Senda et al.
2009/0278782 A1* 11/2009 Chen ..... G09G 3/3677 345/100

(Continued)

FOREIGN PATENT DOCUMENTS

CN 1532601 A 9/2004
CN 1773338 A 5/2006

(Continued)

*Primary Examiner* — Stacy Khoo
(74) *Attorney, Agent, or Firm* — Faegre Baker Daniels LLP

(57) ABSTRACT

A liquid crystal display panel and a liquid crystal display device, where polarities of signals provided by data lines are inversed when half gate lines are scanned to comply with the driving manners of half column inversion, and gate lines on one side which are sequentially scanned line by line from top to bottom are scanned alternately with gate lines on the other side which are sequentially scanned line by line from bottom to top, thus the effect of the dot inversion is realized, thereby reducing the power consumption.

9 Claims, 24 Drawing Sheets

(56) References Cited

U.S. PATENT DOCUMENTS

2011/0134103 A1 6/2011 Nam et al.

FOREIGN PATENT DOCUMENTS

| | | | |
|---|---|---|---|
| CN | 101399024 | A | 4/2009 |
| CN | 101846835 | A | 9/2010 |
| CN | 102629456 | A | 8/2012 |
| KR | 1020110119309 | A | 11/2011 |

* cited by examiner

LIQUID CRYSTAL DISPLAY PANEL AND DISPLAY DEVICE

CROSS-REFERENCE TO RELATED APPLICATION

This application claims priority to Chinese Application No. 201410835764.2, filed Dec. 23, 2014, which is herein incorporated by reference in its entirety.

BACKGROUND

In the field of liquid crystal display technologies, a method for suppressing flickers which commonly occur in a Thin Film Transistor-Liquid Crystal Display (TFT-LCD) is to achieve spatial fusion of respective optical waveforms of adjacent pixels. To this end, the polarities of driving voltages of the adjacent pixels are required to be inverse to each other. There are several driving methods for achieving the inverse polarities of the adjacent pixels, such as a dot inversion, a column inversion, a row inversion and so on. When an image is displayed, a pixel voltage Vp (i.e., a signal voltage Vp on a pixel electrode) applied across liquid crystals may have one of positive and negative polarities. Specifically, the pixel voltage Vp has the positive polarity if it is larger than a common electrode voltage Vcom, and has the negative polarity if it is less than the common electrode voltage Vcom. As long as the absolute value of the pixel voltage Vp applied across liquid crystals is unchanged, a gray scale image can be displayed with the same luminance.

In a frame of image, if the polarity of each dot (i.e. a sub-pixel) maintains inverse to the polarities of dots adjacent to the dot (i.e. four dots respectively located above, below, left and right to the dot), a driving manner of dot inversion is implemented. In the next frame of image, the polarities of the voltages of all sub-pixels are inversed at the same time, and hence the polarities of the adjacent sub-pixels still maintain inverse to each other. The dot inversion manner is the finest in spatial fusion of the flicker since each sub-pixel is dealt with individually, so that the dot inversion manner has an optimal flicker suppressing effect. As shown in FIG. 1, the driving waveform used in the dot inversion has a period of one addressing duration (i.e., one Hsync cycle), so that the dot inversion is regarded as a high-frequency inversion, leading to power consumption which is directly proportional to a square of the frequency. Therefore, the driving manner of dot inversion causes the maximum power consumption compared with other inversion driving manners.

As for a driving manner of column inversion, polarities of sub-pixels corresponding to one of two adjacent data lines are respectively inverse to polarities of sub-pixels corresponding to the other of the two adjacent data lines by column. In such driving manner of column inversion, a phase difference of $\pi$ (180°) is present between the flicker waveforms of the two adjacent columns of sub-pixels, so that the flickers are suppressed in a certain degree. However, no phase difference is present between the flicker waveforms of sub-pixels in each column of sub-pixels, which easily leads to longitudinal line flickers. As shown in FIG. 1, the driving waveform used in the column inversion has a period of one frame of image (i.e., one Vsync cycle) as a unit, thus the column inversion is regarded as a low frequency inversion, leading to the minimal power consumption compared with other inversion driving manners.

Corresponding to the driving manner of the column inversion, there is a driving manner of row inversion.

Specifically, a phase difference of $\pi$ (180°) is present between the flicker waveforms of two adjacent rows of sub-pixels according to the driving manner of row inversion, to suppress the flickers in a certain degree. However, no phase difference is present between the flickers of the sub-pixels in each row of sub-pixels, which easily leads to horizontal line flickers. The voltage frequency of the driving signals for the row inversion is same as that for the dot inversion, thus the driving manner of row inversion has no advantage in power consumption, and hence is generally not used for displaying at present.

SUMMARY

In view of this, embodiments of the disclosure provide a liquid crystal display panel and a display device thereof.

According to embodiments of the disclosure, a liquid crystal display panel, includes:

a plurality of data lines extending along a first direction and a plurality of gate lines extending along a second direction, wherein a plurality of sub-pixels are defined by insulatedly intersecting the plurality of data lines with the plurality of gate lines, wherein each of the plurality of data lines in a column is configured to provide data signals to corresponding sub-pixels by column in the same column, and the polarities of the data signals provided by adjacent data lines are inverse to each other, wherein, during a scanning period for a frame of image, the polarities of the data signals provided by the data lines in the former half of the scanning period for the frame of image are inverse to the polarities of the data signals provided by the data lines in the latter half of the scanning period for the frame of image;

the plurality of gate lines comprise: a group of first gate lines comprising a plurality of first gate lines, and a group of second gate lines comprising a plurality of second gate lines, wherein at least a part of the plurality of first gate lines are alternately arranged line by line with at least a part of the plurality of second gate lines;

the liquid crystal display panel further comprises: a group of first gate drivers configured to drive the group of first gate lines, and a group of second gate drivers configured to drive the group of second gate lines, wherein the group of first gate drivers drive the first gate lines in a direction inverse to a direction in which the group of second gate drivers drive the second gate lines.

In some embodiments of the disclosure, a liquid crystal display device includes the liquid crystal display panel mentioned above.

Embodiments of the disclosure provide a liquid crystal display panel and a liquid crystal display device. According to polarities of signals provided by the data lines, the driving manners of the half column inversion and alternately scanning the gate lines on one side line by line from top to bottom and scanning the gate lines on the other side line by line from bottom to top is performed, and thus the effect of the dot inversion is realized, thereby reducing the power consumption; at the same time, two adjacent gate drivers are sequentially turned on, and the falling edge and the rising edge of the driving signals are both present in an overlapped period $\Delta t$ in time sequence. During the overlapped period $\Delta t$, the data line can perform a pre-charge operation to the sub-pixels connected with the gate driver turned on later, thereby the pixel voltage of the sub-pixels is ensured, so that the quality of the image is at an optimal state, and the flicking phenomena is reduced and the power consumption is low.

While multiple embodiments are disclosed, still other embodiments of the disclosure will become apparent to those skilled in the art from the following detailed description, which shows and describes illustrative embodiments of the disclosure. Accordingly, the drawings and detailed description are to be regarded as illustrative in nature and not restrictive.

BRIEF DESCRIPTION OF THE DRAWINGS

In order to describe the technical solutions in embodiments of the disclosure, the accompanying drawings for the description will be described briefly as follows. The accompanying drawings described below illustrate some embodiments of the disclosure, and are not intended to limit the disclosure

Figure 1:
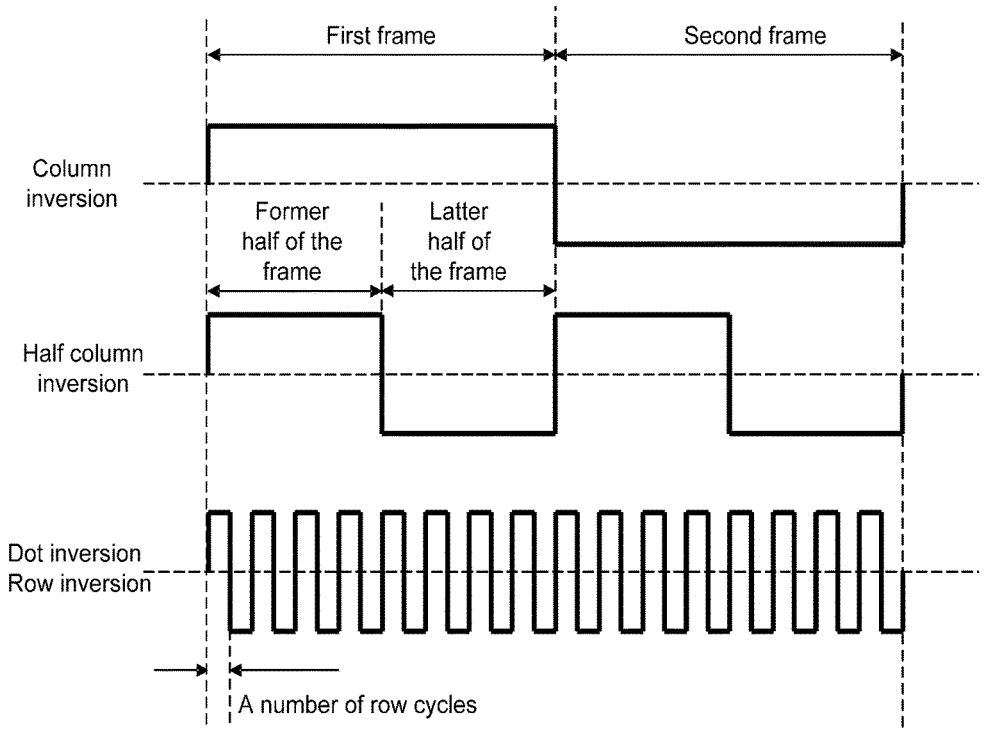
FIG. 1 is a diagram showing waveforms of driving signals for column inversion, half column inversion, dot inversion and row inversion.

While the disclosure is amenable to various modifications and alternative forms, embodiments have been shown by way of example in the drawings and are described in detail below. The intention, however, is not to limit the disclosure to the particular embodiments described. On the contrary, the disclosure is intended to cover all modifications, equivalents, and alternatives falling within the scope of the disclosure as defined by the appended claims.

DETAILED DESCRIPTION

Technical solutions provided in embodiments of the disclosure will be described clearly in detail in combination with the accompanying drawings. It is apparent that only some embodiments are described herein. Based on the embodiments of the disclosure, other embodiments achieved by those skilled in the art fall within the scope of the disclosure.

Figure 2:
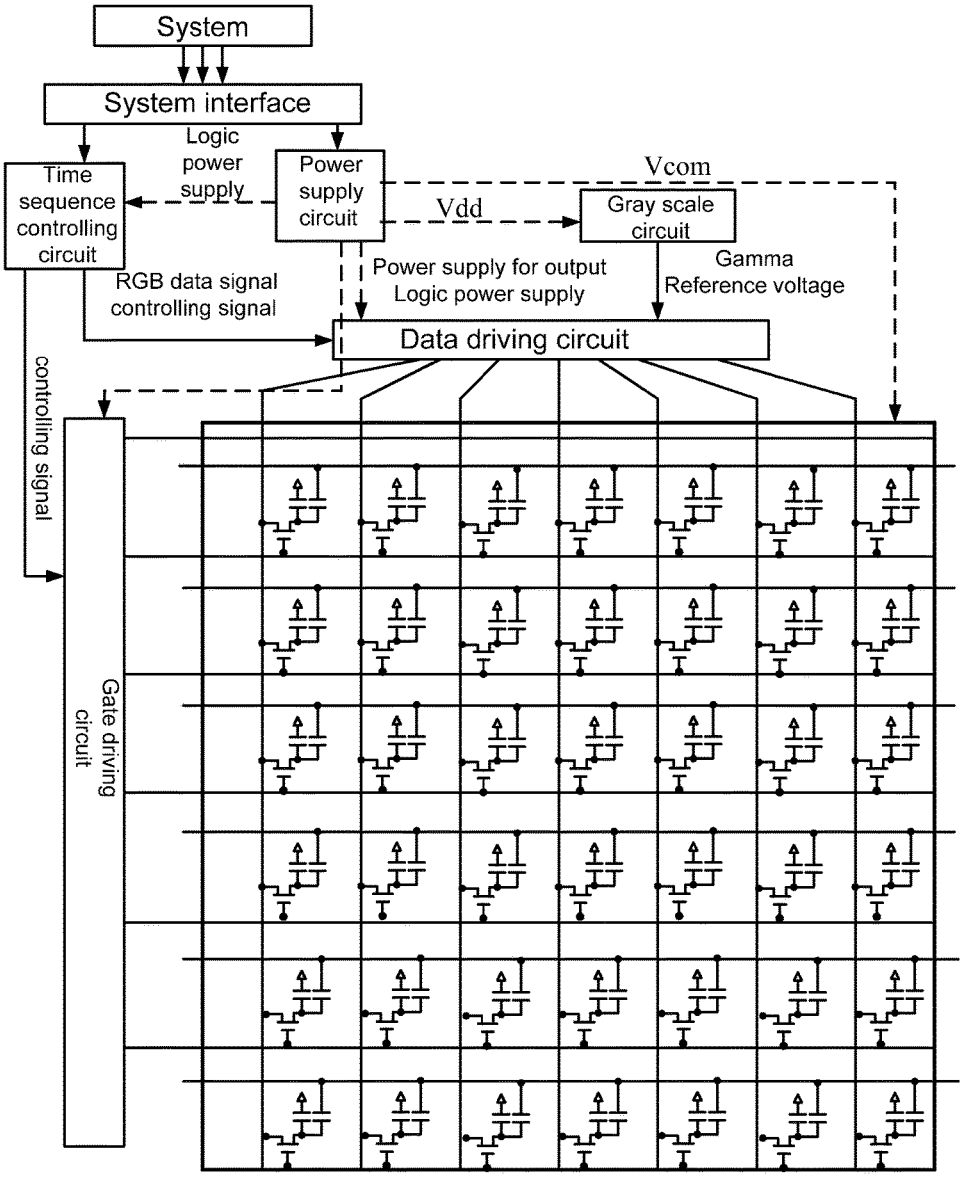
FIG. 2 is a schematic view showing a liquid crystal display panel in the related art.

As shown in FIG. 2, a TFT-LCD driving circuit includes a power supply circuit (Power IC), a time sequence controlling circuit (TCON IC), a gray scale circuit, a data driving circuit (also called a Source Driver IC), a scan driver circuit (also called a Gate Driver IC) and a system interface (System I/F). Signals from systems provide various displaying data and time sequence controlling signals to the TFT-LCD driving circuit through the system interface. A part of the displaying data and time sequence controlling signals are transferred to the power supply circuit to generate a power supply voltage required for other working sites and a liquid crystal deflection reference voltage Vcom. Another part of the displaying data and time sequence control signals are transferred to the time sequence controlling circuit to generate an operational time sequence of the time sequence driving circuit, an operational time sequence of the scan driving circuit, and an overall time sequence of the TFT-LCD. In addition, the data driving circuit is configured to convert a display-related signal from the time sequence controlling circuit into an analog voltage, which is in turn outputted to a pixel electrode to obtain a pixel voltage required for deflection of the liquid crystals. The scan driving circuit is configured to generate a digital voltage with high and low levels, which is in turn outputted to a gate electrode of a TFT switch to control the switching state of each row of pixels. The gray scale circuit is configured to generate a reference voltage required for a digital to analog convert (DAC) of the data driving circuit, and this reference voltage is also referred to as a Gamma reference voltage.

The function of the scan driving circuit is to sequentially output switching voltages for thin film transistors (TFTs) line by line. An output terminal of the scan driving circuit is connected with a gate electrode of the TFT and hence the scan driving circuit is also referred to as a gate driving circuit, which is generally disposed in a longitudinal direction at the left and/or right side of a display panel.

Figure 3:
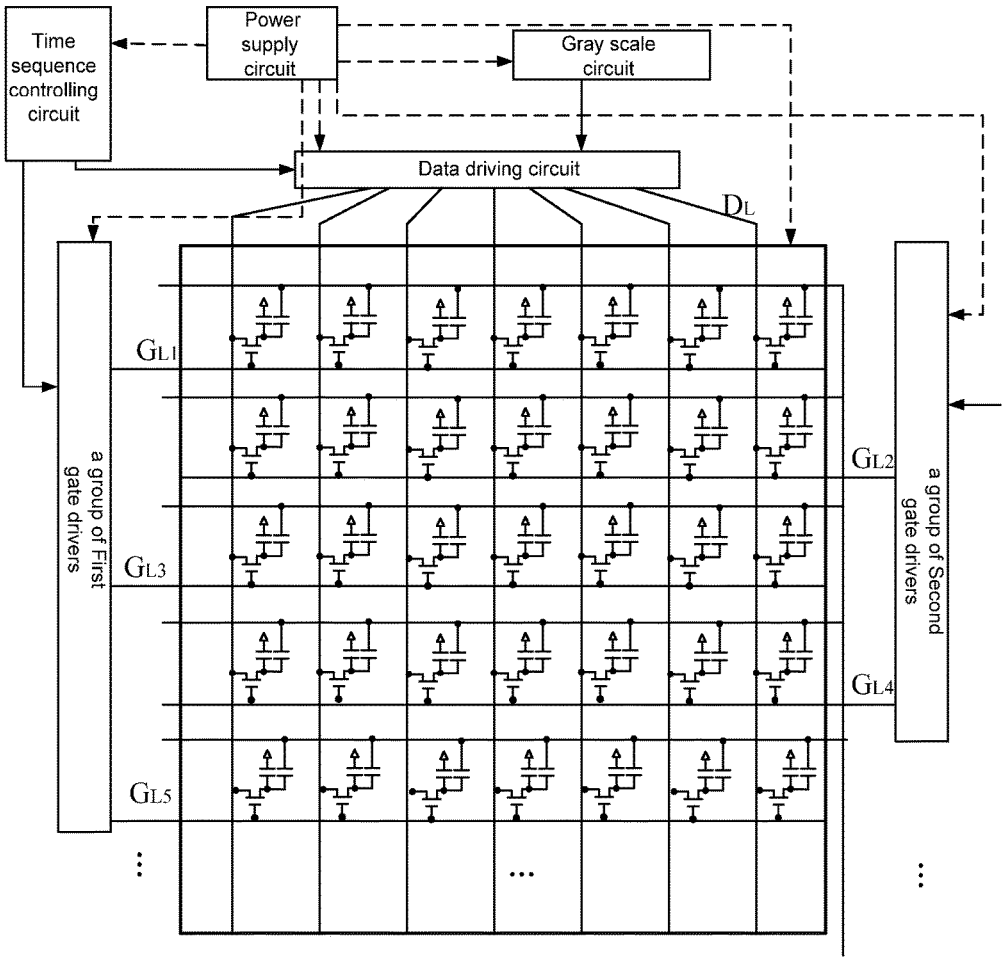
FIG. 3 is a schematic view showing a liquid crystal display panel, according to embodiments of the disclosure.
Figure 4:
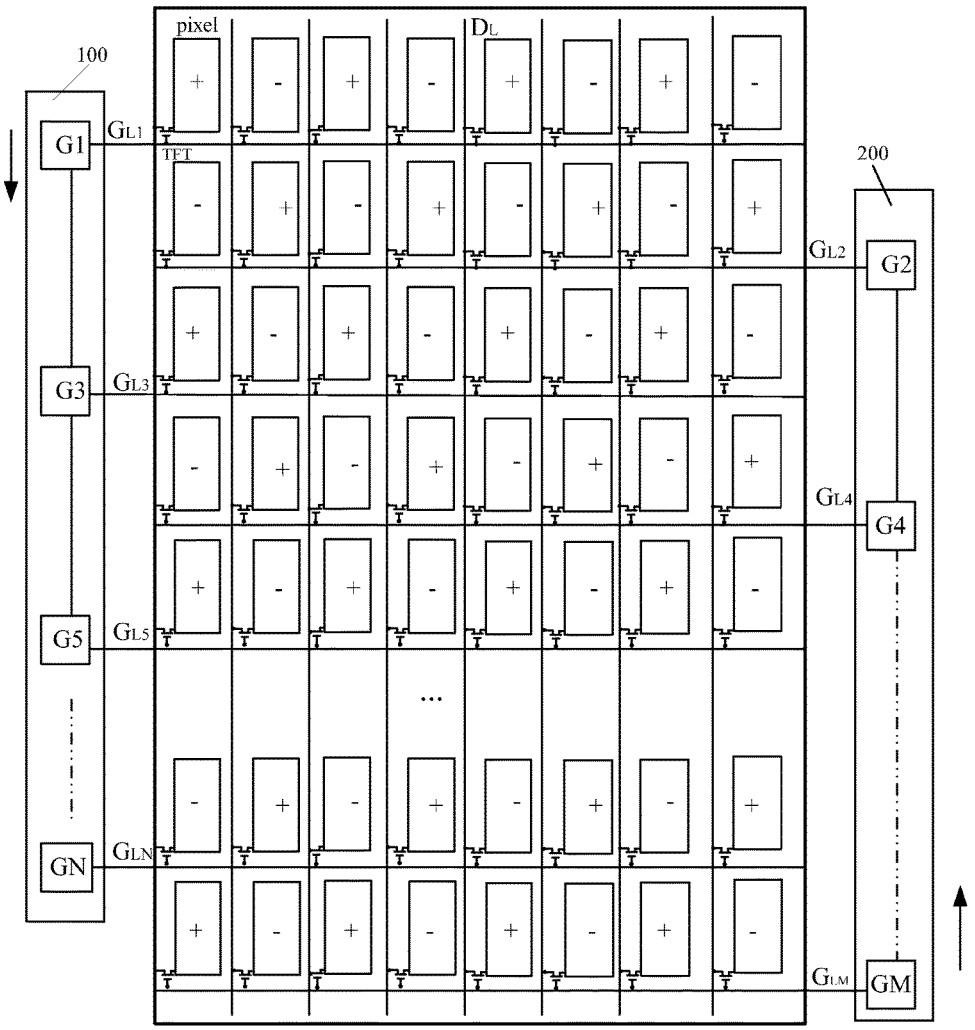
FIG. 4 is a schematic view showing polarity states of sub pixels when one frame of image is displayed by a liquid crystal display panel, according to embodiments of the disclosure.

As shown in FIGS. 3 and 4, the disclosure discloses a liquid crystal display panel, including: a plurality of data lines DL extending along a first direction and a plurality of gate lines $G_{L1}$, $G_{L2}$, $G_{L3}$, . . . , $G_{LM}$ extending along a second direction, where the plurality of data lines are insulatedly intersected with the plurality of gate lines to define a plurality of sub-pixels Pixel;

a group of first gate lines includes a plurality of first gate lines $G_{L1}$, $G_{L3}$, $G_{L5}$, . . . , $G_{LN}$;

a group of second gate lines includes a plurality of second gate lines $G_{L2}$, $G_{L4}$, . . . , $G_{LM}$; where at least a portion of the plurality of first gate lines $G_{L1}$, $G_{L3}$, $G_{L5}$, . . . , $G_{LN}$ are alternately arranged line by line with at least a portion of the plurality of second gate lines $G_{L2}$, $G_{L4}$, . . . , $G_{LM}$. For example, as shown in FIG. 4, the first gate line $G_{L1}$, the second gate line $G_{L2}$, the first gate line $G_{L3}$, the second gate line $G_{L4}$, . . . , the first gate line $G_{LN}$, and the second gate line $G_{LM}$ sequentially alternate line by line in the liquid crystal display panel;

the liquid crystal display panel also includes a group of first gate drivers 100 at the left side of the liquid crystal display panel and a group of second gate drivers 200 at the right side of the liquid crystal display panel, where the group of first gate drivers 100 is configured to drive the group of first gate lines and the group of second gate drivers 200 is configured to drive the group of second gate lines, so as to control turning on and off of TFTs in the corresponding sub-pixels.

The group of first gate drivers 100 includes a plurality of first gate drivers G1, G3, G5, . . . , GN cascadedly-connected with each other, and the first gate drivers are configured to control the first gate lines $G_{L1}$, $G_{L3}$, $G_{L5}$, . . . , $G_{LN}$ respectively in order for driving the group of first gate lines in a forward direction, i.e. sequentially driving the group of first gate lines from top to bottom; also, the group of second gate drivers 200 includes a plurality of second gate drivers G2, G4, . . . , GM cascadedly-connected with each other, and the second gate drivers are configured to control the second gate lines $G_{L2}$, $G_{L4}$, . . . , $G_{LM}$ respectively in order for driving the group of second gate lines in a backward direction, i.e. sequentially driving the group of second gate lines from bottom to top. It should be noted that gate lines connected with the group of first gate drivers 100 are categorized into the group of first gate lines, and gate lines connected with the group of second gate drivers 200 are categorized into the group of second gate lines.

Figure 5:
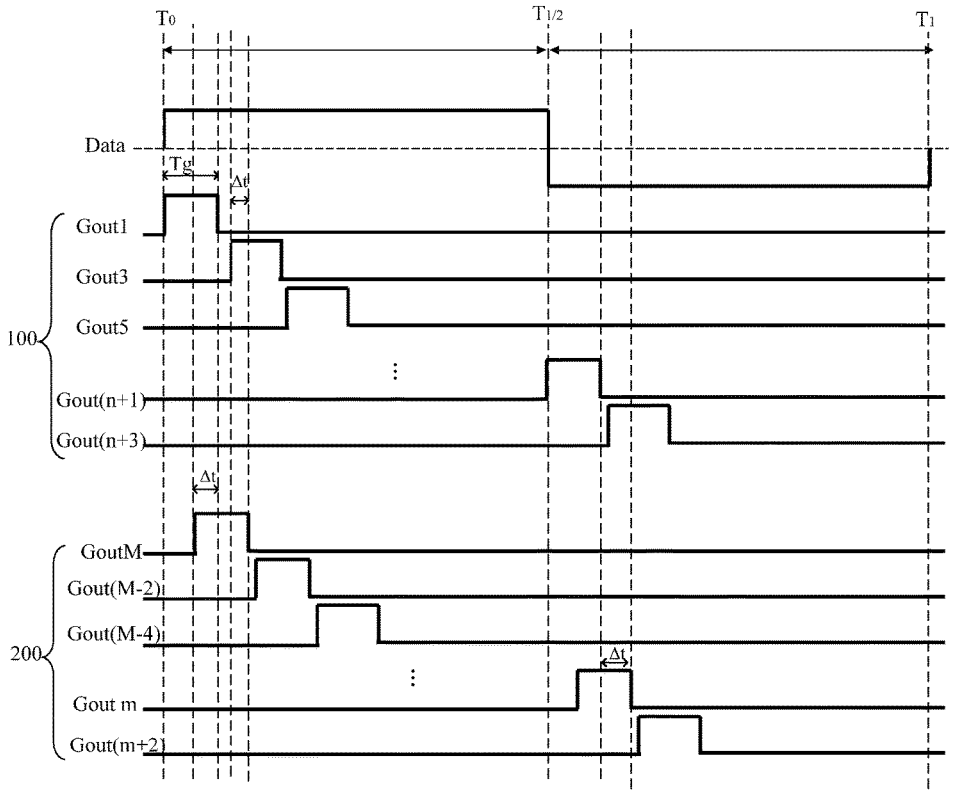
FIG. 5 is a diagram showing an operational time sequence of the liquid crystal display panel shown in FIG. 4.

In addition, as shown in FIGS. 4 and 5, data lines DL are configured to provide data signals to corresponding sub-pixels (i.e., for a charging operation) generally by column, more particularly, each of the data lines is configured to provide a data signal to the corresponding sub pixels in a column, and polarities of the data signals provided by the adjacent data lines are inverse to each other. During a scanning period ($T_0$-$T_1$) for one frame of image, the polarity of the data signal provided by a data line DL during the former half ($T_0$-$T_{1/2}$) of the scanning period ($T_0$-$T_1$) for the frame of image is inverse to the polarity of the data signal provided by the data line DL in the latter half ($T_{1/2}$-$T_1$) of the scanning period ($T_0$-$T_1$), that is, during the latter half ($T_{1/2}$-$T_1$) of the scanning period ($T_0$-$T_1$), the data signal Data provided by the data line DL is applied to the sub-pixel to inverse the polarity of the sub-pixel, in other words, the polarity of the data signal Data complies with the half column inversion (which means that the polarity of the data signal is inversed when half of the gate lines are scanned in the column direction), as shown by the waveform of the driving signal for the half column inversion in FIG. 1.

As such, the group of first gate drivers 100 is configured to drive the group of first gate lines in a forward direction, i.e. in a scanning manner for example from top to bottom, and the group of second gate drivers 200 is configured to drive the group of second gate lines in a backward direction, i.e. in a scanning manner for example from bottom to top, resulting in generally a driving manner in which the group of first gate lines are scanned line by line alternately with and in a reverse direction to the group of second gate drivers. That is, at least a part of the first gate drivers G1, G3, G5, . . . , GN in the group of first gate drivers 100 are turned on alternately with at least a part of the second gate drivers G2, G4, . . . , GM in the group of second gate drivers 200 in order to scan the gate lines. As shown in FIG. 4, the first gate line $G_{L1}$, the second gate line $G_{LM}$, the first gate line $G_{L3}$, . . . , the first gate line $G_{LN}$, and the second gate line $G_{L2}$ are sequentially scanned by the corresponding gate drivers.

As shown in FIG. 5, during the former half ($T_0$-$T_{1/2}$) of the scanning period ($T_0$-$T_1$) for the frame of image, the group of first gate drivers 100 finish scanning the first gate lines in the upper half of a display region of the liquid crystal display panel in the forward direction from top to bottom, and the group of second gate drivers 200 finish scanning the second gate lines in the lower half of the display region of the liquid crystal display panel in the backward direction from bottom to top; also, during the latter half ($T_{1/2}$-$T_1$) of the scanning period ($T_0$-$T_1$) for the frame of image, the polarities of the data signals Data provided by the data lines DL are inversed. That is, when a gate line (e.g., a gate line $G_{n+1}$ in the example shown in FIG. 5) disposed at an intermediate position within the region where all the gate lines are arranged is to be scanned, the polarities of the data signals Data provided by the data lines DL are inversed starting from the gate line $G_{n+1}$, so that the polarities of the data signals Data applied to the sub-pixels connected with the gate line $G_{n+1}$ are inversed relative to the polarities of the data signals Data applied to these sub-pixels connected with a gate line which is scanned preceding to the gate line $G_{n+1}$. Due to the driving manner for scanning alternately in reverse directions and the fact that the polarities of the data signals Data provided by the data lines DL comply with the half column inversion, as shown in FIG. 5, sub-pixels in a region where the first gate lines are alternately arranged line by line with the second gate lines in the liquid crystal display panel comply with dot inversion, as shown in FIG. 4. That is, in a frame of image, the polarity of each dot (i.e. sub-pixel) in the region is maintained inverse to the polarities of dots (i.e. sub-pixels) which are adjacent to the dot and are respectively located above, below, left and right to the dot. The dot inversion manner is the finest in spatial fusion of the flicker since each sub-pixel is dealt with individually, so that the dot inversion manner has an optimal flicker suppressing effect, thereby achieving a displayed image with high quality. Further, still referring to FIG. 1, the times of polarity inversions for the half column inversion is significantly less than the times of polarity inversions in the dot inversion, and hence the power consumption is significantly lowered compared with the dot inversion.

Still referring to FIG. 5, the first gate drivers are sequentially turned on alternately with the second gate drivers, that is, the second gate drivers are sequentially turned on alternately with the first gate drivers. Here, the first gate driver G1 and the second gate driver GM are illustratively described for example. After the first gate driver G1 outputs a first driving signal $Gout_1$, the second gate driver GM outputs a second driving signal $Gout_M$. The first driving signal $Gout_1$ overlaps with the second driving signal $Gout_M$ for an overlapped period Δt, and specifically, the falling edge of the first driving signal $Gout_1$ is later than the rising edge of the second driving signal $Gout_M$, and the overlapped period Δt is less than a period Tg during which the first driving signal $Gout_1$ maintains at a high level state.

Since the second gate driver GM is turned on before the first gate driver G1 finishes scanning the corresponding gate line, the overlapped period Δt is present. During the overlapped period Δt, the data lines DL can provide the data signals to the row of sub-pixels corresponding to the second gate line $G_{LM}$ controlled by the second gate driver GM, to pre-charge the sub-pixels, that is, the sub-pixels are charged in advance so as to achieve setting of the pixel voltage in time. That is, during the overlapped period Δt, the TFTs connected to the second gate line $G_{LM}$ controlled by the second gate driver GM are turned on, and pixel voltages of the same polarities as the preceding row of sub-pixels are applied to pixel electrodes in the row of sub-pixels corresponding to the second gate line $G_{LM}$ by the data lines DL. For example, assuming that a +5V pixel voltage is to be applied to a row of sub-pixels for displaying, since TFTs connected to a gate line for the row of sub-pixels are already turned on in the pre-charge stage, the data lines can pre-charge the row of sub-pixels, for example, +2V~+3V voltage signals are applied to the row of sub-pixels in the pre-charge stage, so that the attenuation of the pixel voltage can be alleviated, thereby ensuring the pixel voltage of the sub-pixels and achieving the displayed image of better quality. It is noted that the length of the overlapped period Δt can be adjusted depending on the specific design of the driving circuit, such as the size of a gray scale voltage and the degree of the attenuation of the pixel voltage.

Figure 12:
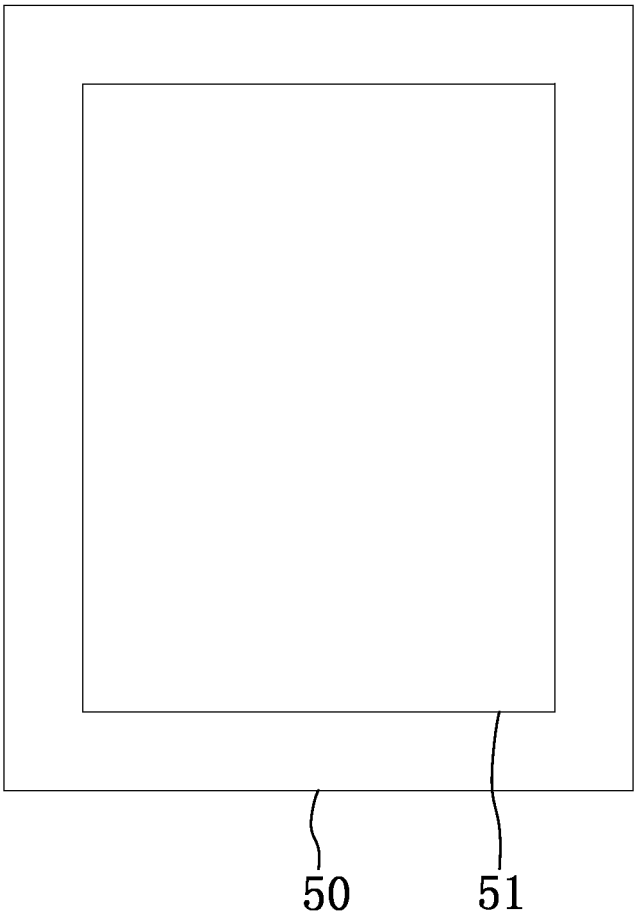
FIG. 12 is a schematic view of a liquid crystal display device, according to embodiments of the disclosure.

Referring still to FIGS. 4, 5 and 12, embodiments further provide a method for driving the liquid crystal display panel mentioned above, and the method includes the following steps.

Herein, the provision of data signals, via data lines DL, to corresponding sub-pixels by column means charging the sub-pixels, and the polarities of the data signals provided by the adjacent data lines are inverse to each other. During a scanning period ($T_0$-$T_1$) for a frame of image, the polarity of the data signal provided by a data line DL during the former half ($T_0$-$T_{1/2}$) of the scanning period ($T_0$-$T_1$) for the frame of image is inverse to the polarity of the data signal provided by the data line DL in the latter half ($T_{1/2}$-$T_1$) of the scanning period ($T_0$-$T_1$) for the frame of image. Thus, during the latter half ($T_{1/2}$-$T_1$) of the scanning period ($T_0$-$T_1$) for the frame of image, the data signal Data provided by the data line DL is applied to the sub-pixel to inverse the polarity of the sub-pixel, in other words, the polarity of the data signal Data complies with the half column inversion.

During the former half ($T_0$-$T_{1/2}$) of the scanning period ($T_0$-$T_1$) for the frame of image, first gate lines from the group of first gate lines are driven from top to bottom (i.e. a direction of the arrow as shown in FIG. 4) by the first gate line driver 100, that is, high level signals are sequentially applied to the first gate lines in the upper half of the display panel line by line; and second gate lines from the group of second gate lines are driven inversely from bottom to top (i.e. a direction of the arrow as shown in FIG. 4) by the second gate line driver 200, that is, high level signals are sequentially applied to the second gate lines in the lower half of the display panel line by line; when the row of sub-pixels are turned on, the data lines DL provide first data signals to the corresponding sub-pixels by column.

Further, during the latter half ($T_{1/2}$-$T_1$) of the scanning period ($T_0$-$T_1$) for the frame of image, the subsequent first gate lines from the group of first gate lines are driven in the forward direction from top to bottom (i.e. the direction of the arrow as shown in FIG. 4) by the first gate line driver 100, that is, high level signals are sequentially applied to the first gate lines in the lower half of the display panel line by line; and the subsequent second gate lines from the group of second gate lines are driven in the backward direction from bottom to top (i.e. the direction of the arrow as shown in FIG. 4) by the second gate line driver 200, that is, high level signals are sequentially applied in the backward direction to the second gate lines in the upper half of the display panel line by line, where, after the row of sub-pixels are turned on, the data lines DL provide second data signals to the sub-pixels by column, and the polarity of the second data signal Data applied to the sub-pixel by the data line DL is inverse to that of the first data signal (as shown in FIG. 5), that is, during the latter half ($T_{1/2}$-$T_1$) of the scanning period ($T_0$-$T_1$) for the frame of image, the polarity of the sub-pixel to which the second data signal is applied is inversed by the second data signal.

The gate driving circuit drives the liquid crystal display panel in such a driving manner that: the gate lines are sequentially driven line by line by the group of first gate drivers and the group of second gate drivers alternately, and the driven periods of the consecutively driven gate lines overlap with each other for an overlapped period Δt mentioned above. For example, the driven period in which the first gate line $G_{L1}$ is driven overlaps for the overlapped period Δt with the driven period in which the second gate line $G_{LM}$ is driven, and during the overlapped period Δt, the data line DL can pre-charge the sub-pixels connected with the gate line to be driven subsequently. It is noted that the length of the overlapped period Δt can be adjusted as desired.

The liquid crystal display panel and the driving manner thereof will be further described in detail below by taking the liquid crystal display panel having a 8×8 resolution as an example:

As shown in FIGS. 6A to 6G and FIG. 9, a liquid crystal display panel includes a group of first gate drivers 100 and a group of second gate drivers 200 longitudinally disposed at both sides of the liquid crystal display panel, respectively, where the group of first gate drivers 100 includes four first gate drivers G1, G3, G5 and G7 cascadedly-connected with each other, the group of second gate drivers 200 includes four second gate drivers G2, G4, G6 and G8 cascadedly-connected with each other, a group of first gate lines includes first gate lines $G_{L1}$, $G_{L3}$, $G_{L5}$ and $G_{L7}$, and a group of second gate lines includes second gate lines $G_{L2}$, $G_{L4}$, $G_{L6}$ and $G_{L8}$, where the first gate lines are alternately arranged line by line with the second gate lines. As shown in FIGS. 6A-6G, in the liquid crystal display panel, the first gate line $G_{L1}$, the second gate line $G_{L2}$, the first gate line $G_{L3}$, the second gate line $G_{L4}$, the first gate line $G_{L5}$, the second gate line $G_{L6}$, the first gate line $G_{L7}$ and the second gate line $G_{L8}$ are sequentially arranged.

The first gate drivers G1, G3, G5 and G7 longitudinally disposed at the left side of the display panel are connected with and configured to control the first gate lines $G_{L1}$, $G_{L3}$, $G_{L5}$ and $G_{L7}$, respectively; and the second gate drivers G2, G4, G6 and G8 longitudinally disposed at the right side of the display panel are connected with and configured to control the second gate lines $G_{L2}$, $G_{L4}$, $G_{L6}$ and $G_{L8}$, respectively. In scanning for displaying an image, the first gate drivers and the second gate drivers are turned on alternately.

In addition, the provision of data signals, via data lines DL, to corresponding sub-pixels by column means charging the sub-pixels, and polarities of the data signals provided by the adjacent data lines DL are inverse to each other.

The specific operational time sequence of the driving circuit is shown in FIGS. 6A-6G and FIG. 9.

During the former half ($T_0$-$T_{1/2}$) of the scanning period ($T_0$-$T_1$) for one frame of image, the data signal Data provided by the data line DL is at a high level, and the polarities of the data signals provided by two data lines DL connected with two adjacent columns of sub-pixels are inverse to each other. For example, for a first data line and a second data line connected to two adjacent columns of sub-pixels, when the first data line outputs a positive data signal to a first sub-pixel in the column of sub-pixels corresponding to the first data line, the second data line outputs a negative data signal to a second sub-pixel in the column of sub-pixels corresponding to the second data line, so that the polarity of the first sub-pixel is inverse to that of the adjacent second sub-pixel. The group of first gate drivers 100 drives gate lines in a direction inverse to a direction in which the group of second gate drivers 200 drives gate lines. For example, the group of first gate drivers 100 is configured to scan the group of first gate lines in a forward direction (i.e., the arrow direction at the left side of the display panel as shown in FIGS. 6A-6G), and the group of second gate drivers 200 is configured to scan the group of second gate lines in a backward direction (i.e., the arrow direction at the right side of the display panel as shown in FIGS. 6A-6G).

Figure 6A:
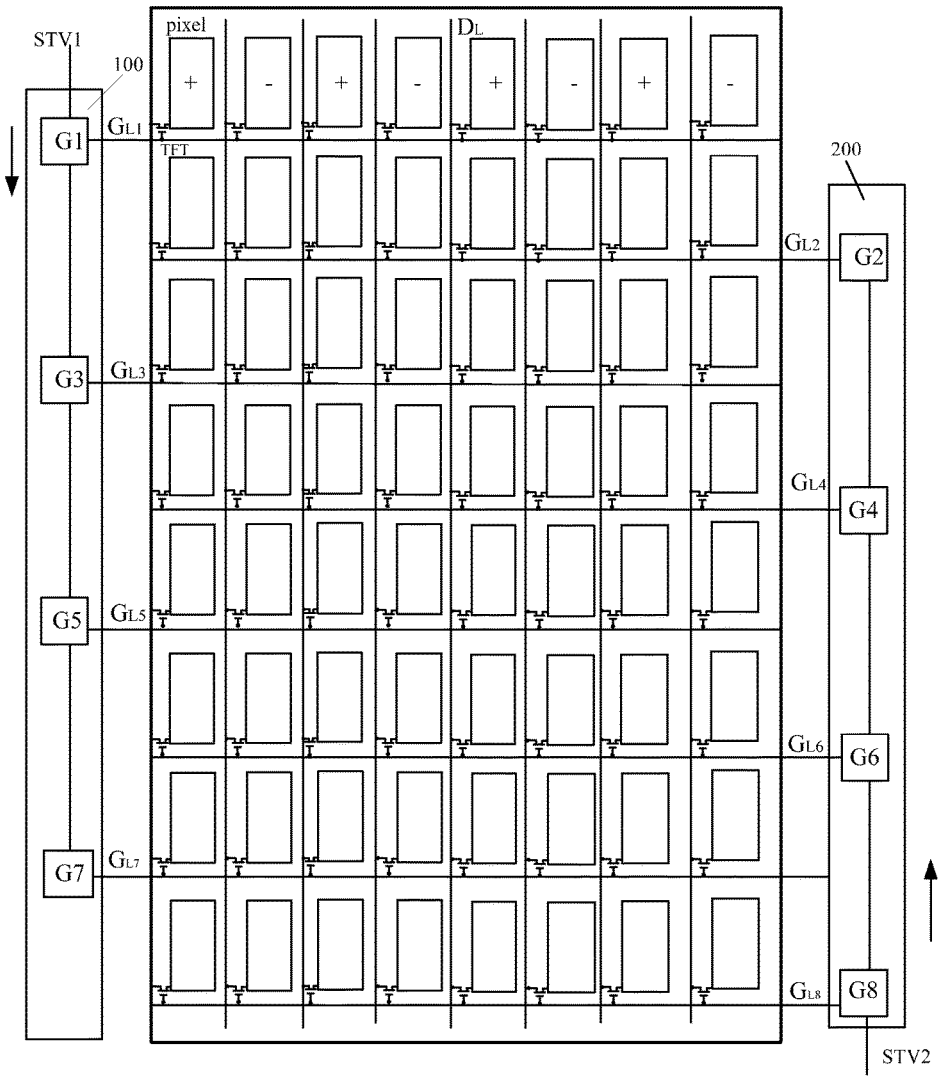
FIGS. 6A to 6G are schematic views showing polarity states of sub-pixels in different periods when one frame of image is displayed by a liquid crystal display panel having a 8×8 resolution, according to embodiments of the disclosure.
Figure 9:
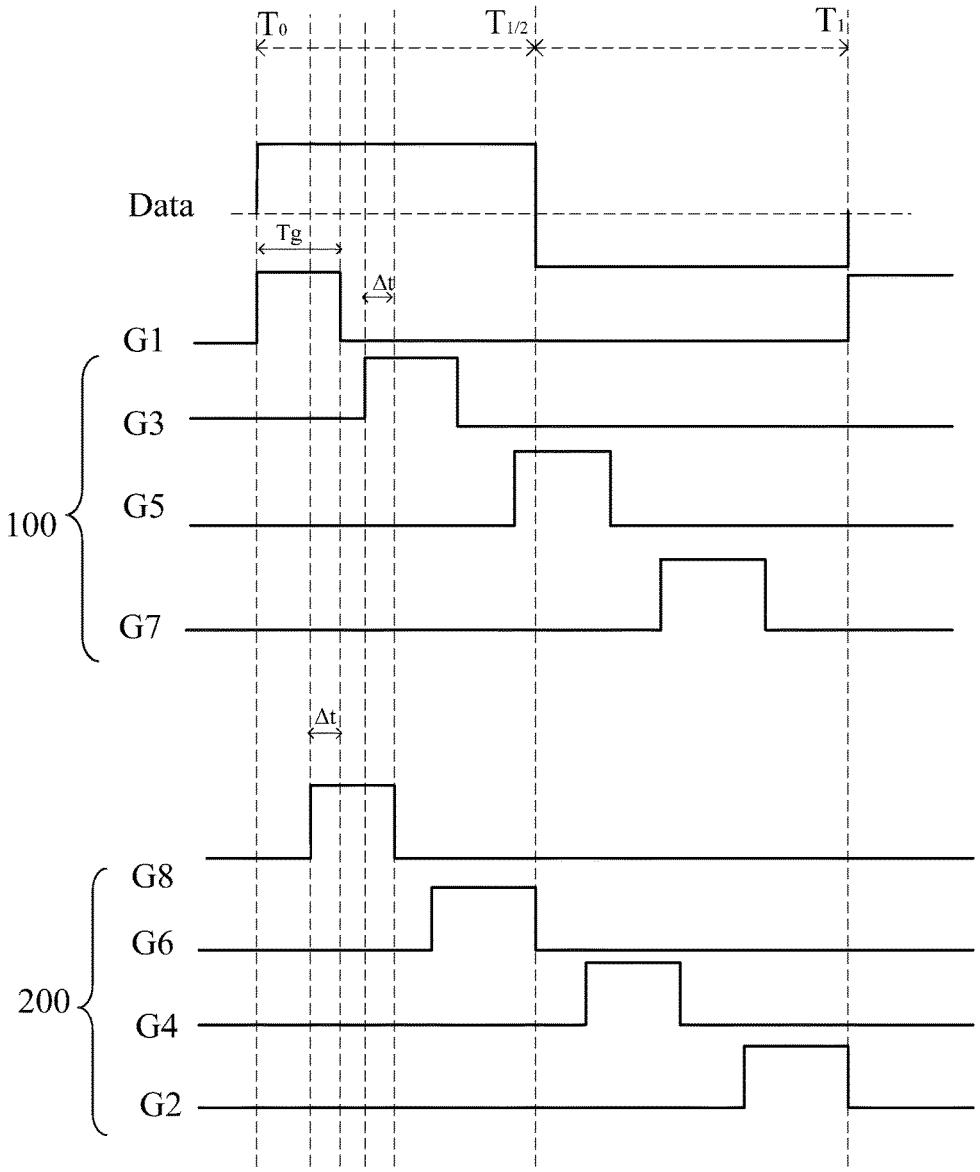
FIG. 9 is a diagram showing an operational time sequence of the liquid crystal display panel shown in FIGS. 6A to 6G.

As shown in FIG. 6A and FIG. 9, the group of first gate drivers 100 receives a first initial signal STV1, and the group of second gate drivers 200 receives a second initial signal STV2; and a first gate driver G1 outputs a gate driving signal to turn on all the TFTs controlled by the first gate line $G_{L1}$, so that first data signals Data are applied to the row of sub-pixels connected with the TFTs controlled by the first gate line $G_{L1}$.

Figure 6B:
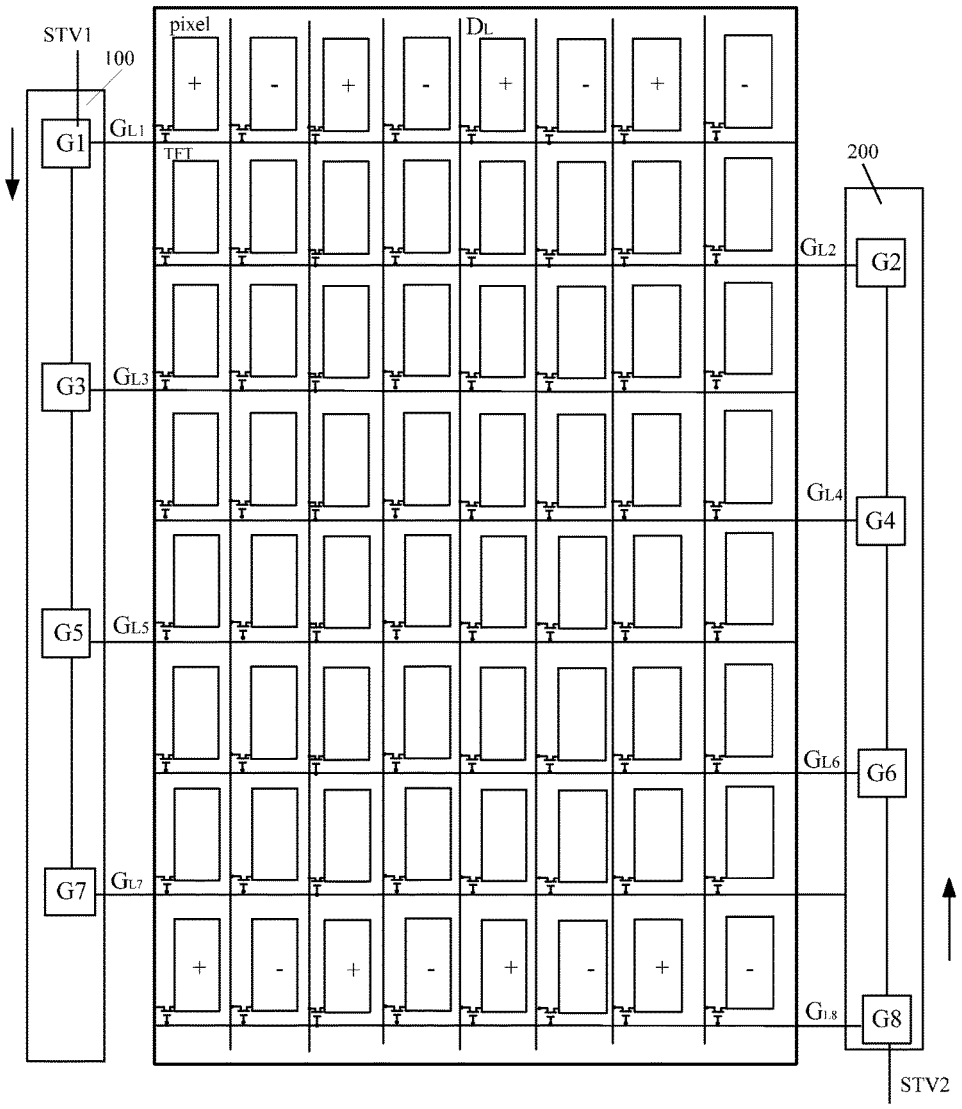

Thereafter, as shown in FIGS. 6B and 9, a second gate driver G8 outputs a gate driving signal to turn on all the TFTs controlled by the second gate line $G_{L8}$, so that first data signals Data are applied to the row of the sub-pixels connected with TFTs controlled by the second gate line $G_{L8}$.

Figure 6C:
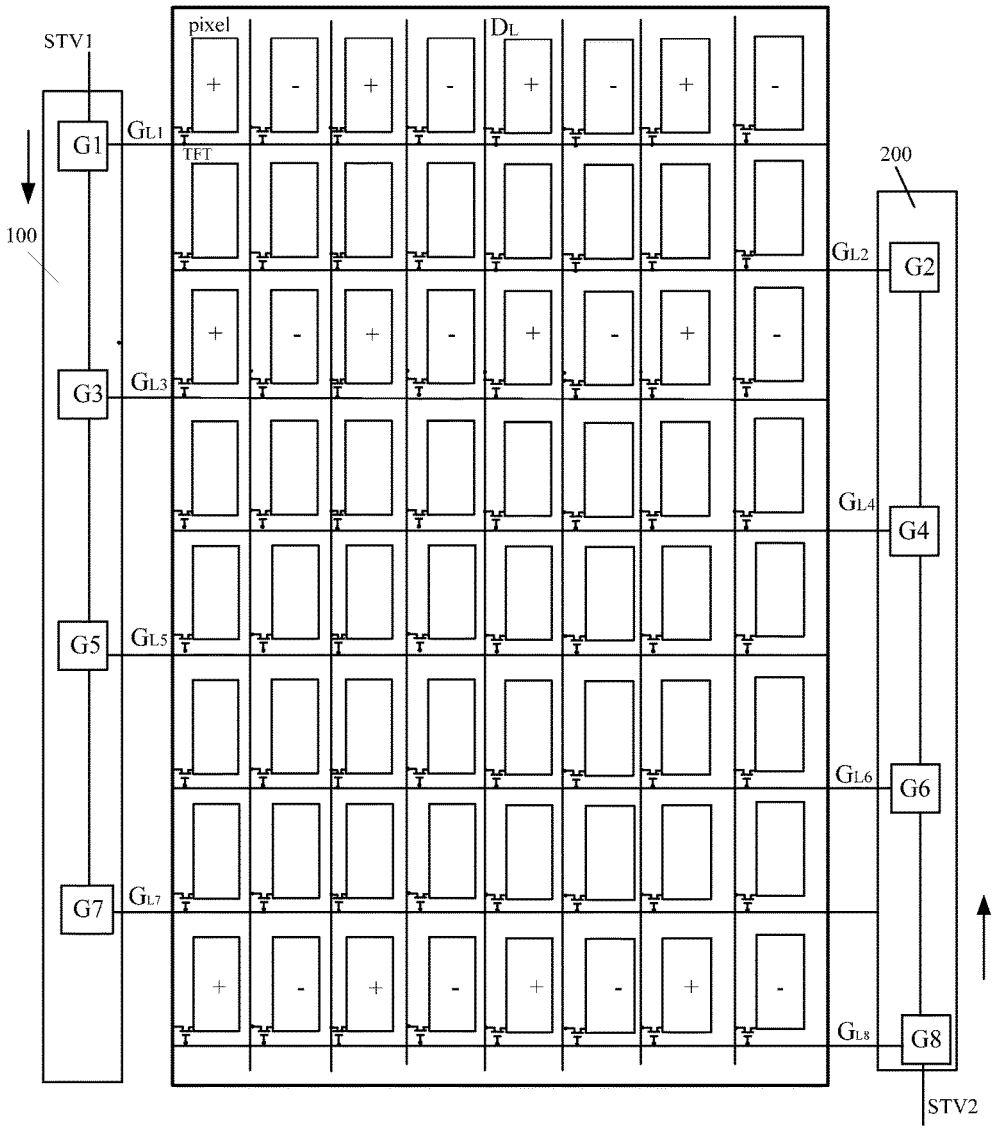

Thereafter, as shown in FIGS. 6C and 9, a first gate driver G3 outputs a gate driving signal to turn on all the TFTs controlled by the first gate line $G_{L3}$, so that first data signals Data are applied to the row of sub-pixels connected with the TFTs controlled by the first gate line $G_{L3}$.

Figure 6D:
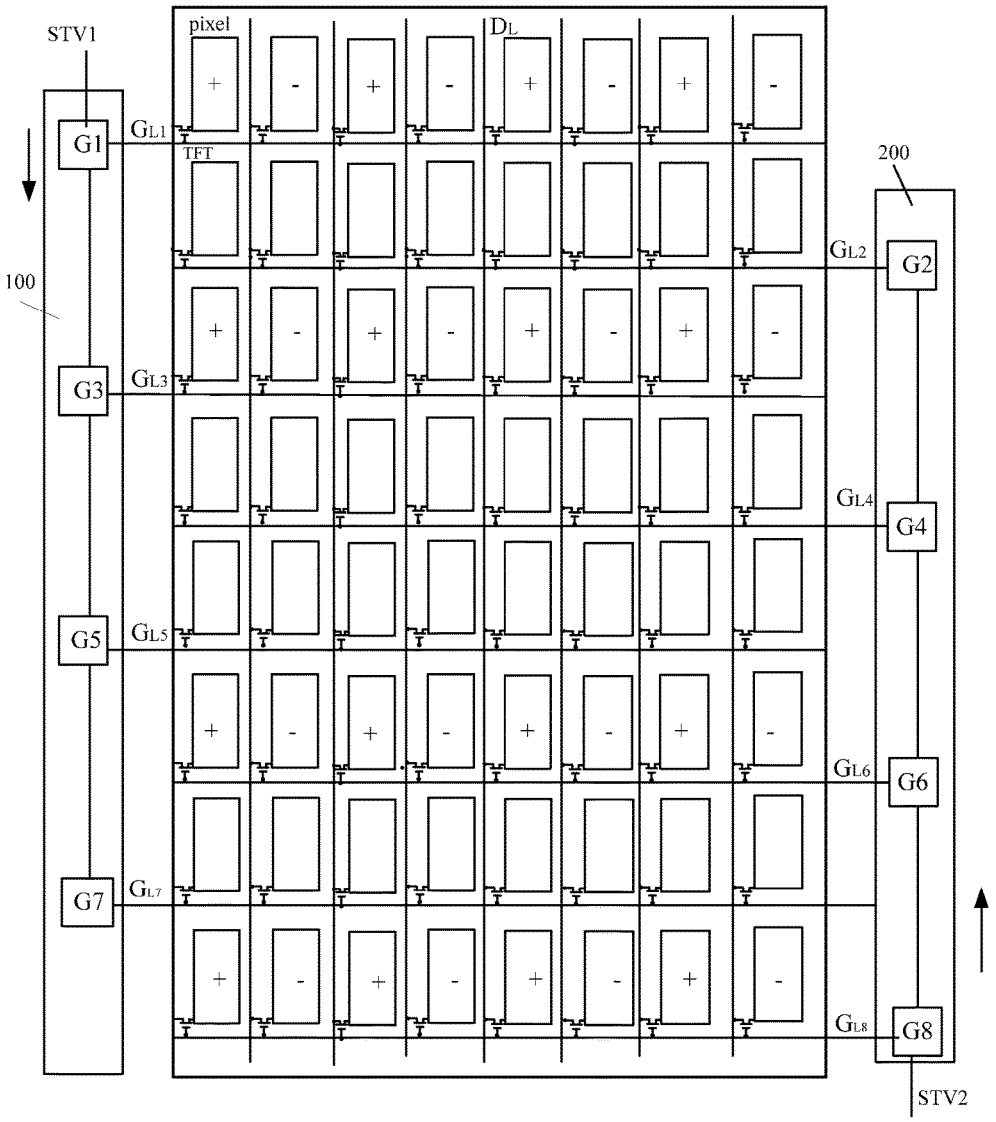

Thereafter, as shown in FIGS. 6D and 9, a second gate driver G6 outputs a gate driving signal to turn on all the TFTs controlled by the second gate line $G_{L6}$, so that first data signals Data are applied to the row of sub-pixels connected with the TFTs controlled by the second gate line $G_{L6}$.

Thereafter, during the latter half ($T_{1/2}$-$T_1$) of the scanning period ($T_0$-$T_1$) for the frame of image, the data signals Data provided by the data lines DL, the polarities of which are inversed, are applied to the remaining sub-pixels not yet applied with the data signals, so that the polarities of the remaining sub-pixels are inverse to the polarities of the sub-pixels which were scanned during the former half ($T_0$-$T_{1/2}$) of the scanning period ($T_0$-$T_1$) for the frame of image. For example, as shown in FIG. 9, at a time point $T_{1/2}$, the polarity of the data signal provided by the data line DL is inversed, that is, the first data signal Data provided by the data line DL is changed from a positive voltage signal to a negative voltage signal, which is referred to as a second data signal Data, so that the polarity of the corresponding sub-pixel is inversed accordingly, thereby resulting in a half column inversion.

Figure 6E:
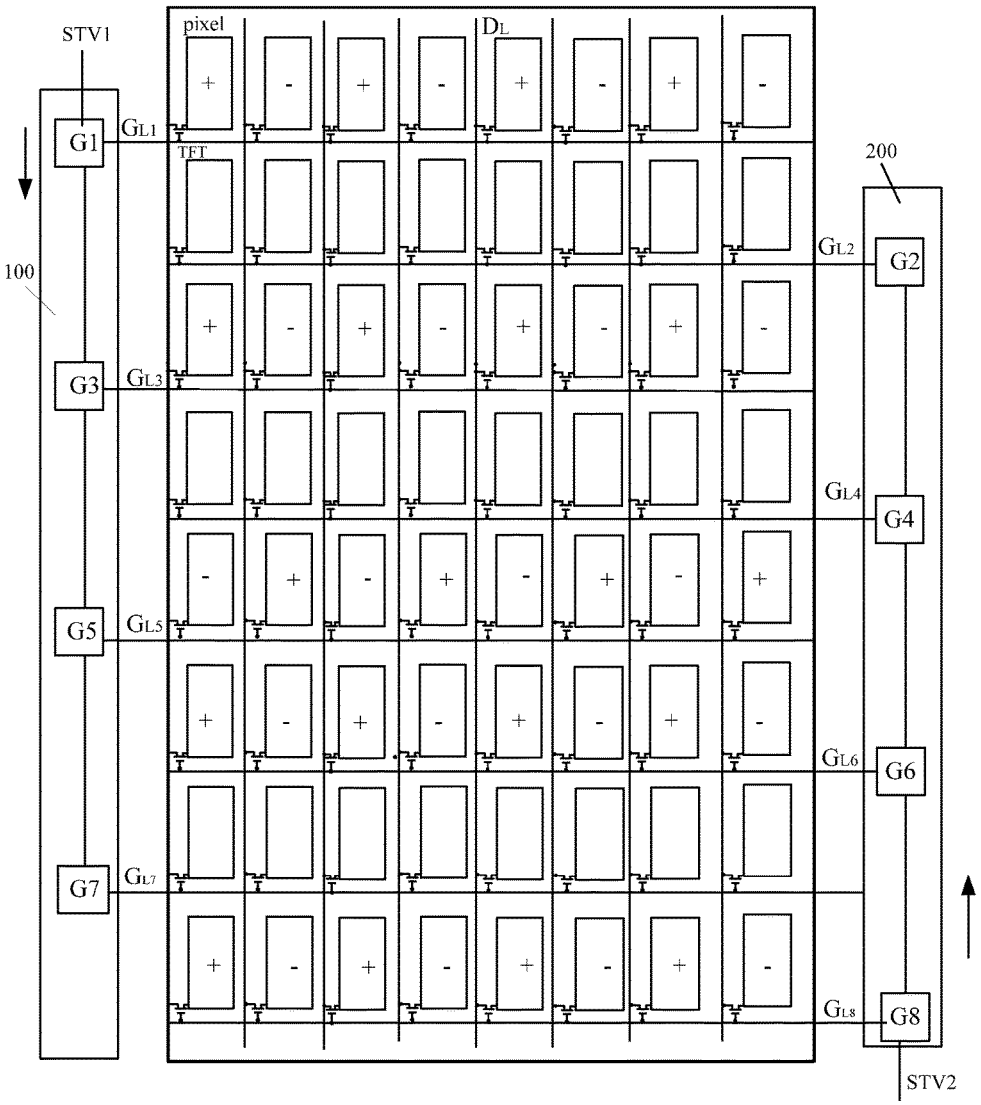

As shown in FIGS. 6E and 9, the first gate driver G5 outputs a gate driving signal to turn on all the TFTs controlled by a first gate line $G_{L5}$, so that second data signals Data are applied to the row of sub-pixels connected with the TFTs controlled by a first gate line $G_{L5}$. At this time, the polarities of the second data signals Data on the data lines DL applied to the row of sub-pixels connected with the first gate line $G_{L5}$ are inverse to polarities of the first data signals Data applied to the row of sub-pixels connected with the second gate line $G_{L6}$ which was immediately precedingly driven.

Figure 6F:
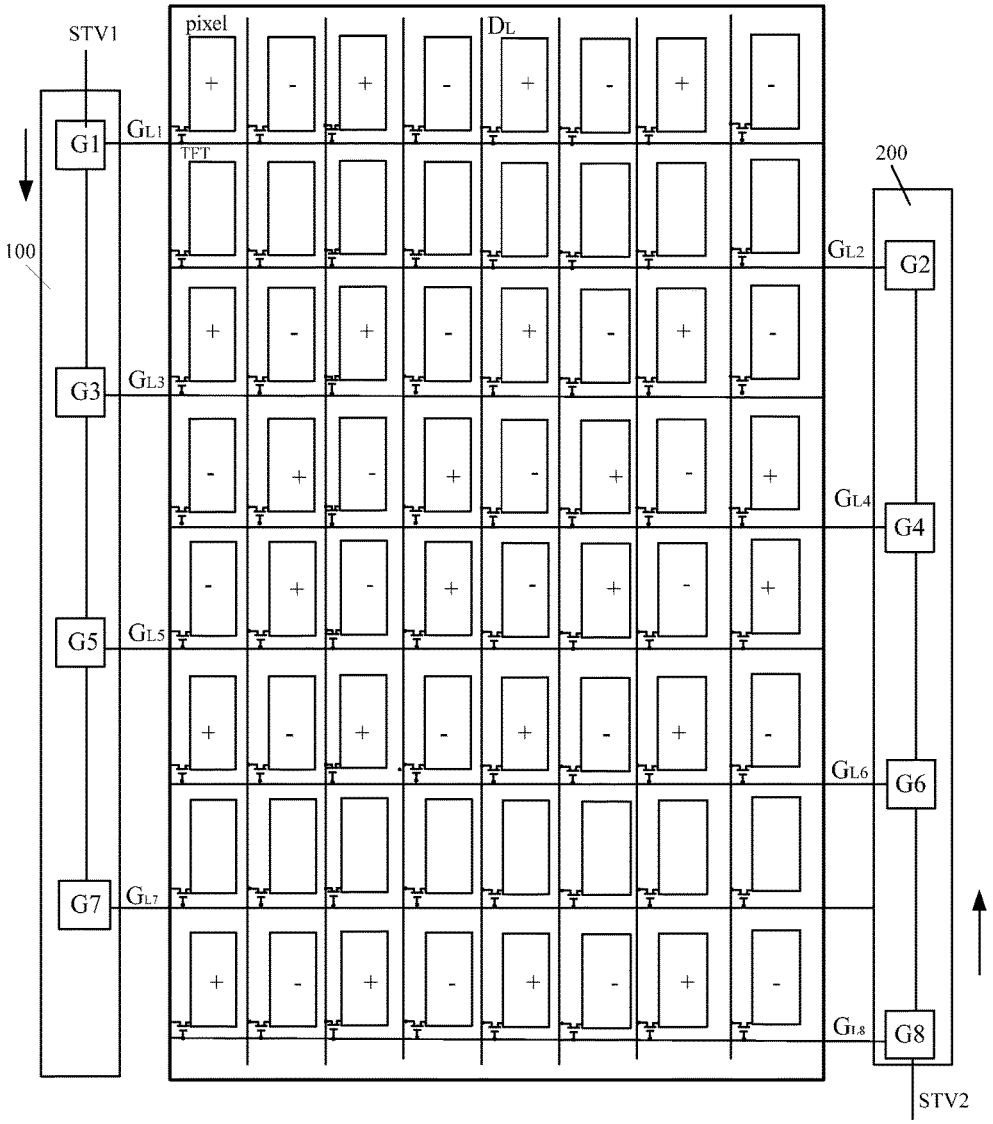

Thereafter, as shown in FIG. 6F and FIG. 9, a second gate driver G4 outputs a gate driving signal to turn on all the TFTs controlled by the second gate line $G_{L4}$, so that second data signals Data are applied to the row of sub-pixels connected with the TFTs controlled by the second gate line $G_{L4}$.

Figure 6G:
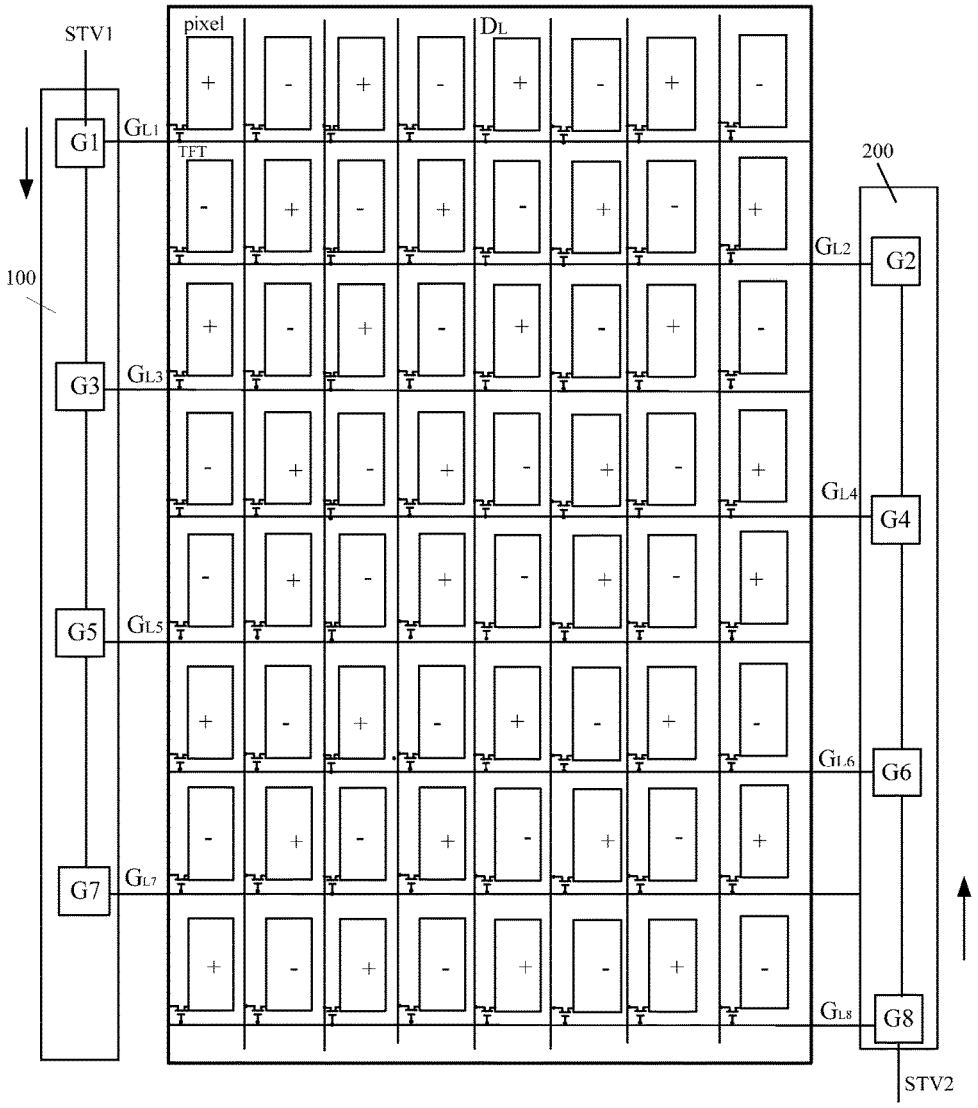

Thereafter, as shown in FIG. 6G and FIG. 9, a first gate driver G7 outputs a gate driving signal to turn on all the TFTs controlled by the first gate line $G_{L7}$, so that second data signals Data are applied to the row of sub-pixels connected with the TFTs controlled by the first gate line $G_{L7}$; thereafter, a second gate driver G2 outputs a gate driving signal to turn on all the TFTs controlled by the first gate line $G_{L2}$, so that second data signals Data are applied to the row of sub-pixels connected with the TFTs controlled by the first gate line $G_{L2}$, thereby finishing a scanning and driving operation of one frame.

As known from FIG. 6G, during the scanning period ($T_0$-$T_1$) for the frame of image, except for that the polarities of the fourth row of sub-pixels are same as the polarities of the fifth row of sub-pixels at intermediate positions within the region where all the gate lines are arranged, the polarity of each sub-pixel other than the fourth and fifth rows of sub-pixels is inverse to the polarities of its four adjacent sub-pixels (which are respectively located above, below, left and right to the sub-pixel), thereby resulting in a dot inversion driving manner, so that the optimal flicker suppressing effect and the lowered power consumption can be achieved, thus achieving the displayed image with high quality.

Referring still to FIG. 9, since the second gate line $G_{L8}$ is driven (i.e. scanned) after the first gate line $G_{L1}$ is driven and before the first gate line $G_{L1}$ is finished being driven, the driven periods of the first gate line $G_{L1}$ and the second gate line $G_{L8}$ overlap with each other, that is, the falling edge of the first driving signal $Gout_1$ output by the first gate driver G1 is later than the rising edge of the second driving signal $Gout_8$ output by the second gate driver G8 by an overlapped period Δt. During the overlapped period Δt, the data lines DL can pre-charge the sub-pixels connected with the second gate driver G8 (i.e. the sub-pixels controlled by the second gate line $G_{L8}$), thereby ensuring the pixel voltage of the row of the sub-pixels. Of course, the overlapped period Δt is less than a period Tg during which the first driving signal $Gout_1$ maintains at a high level state. In addition, the overlapped period Δt can be correspondingly adjusted depending on the corresponding circuitry design.

As described above, in displaying one frame of image by the above liquid crystal display panel, the polarities of the fourth row of sub-pixels connected with the second gate line $G_{L4}$ are same as those of the fifth row of sub-pixels connected with the first gate line $G_{L5}$ at intermediate positions within the region where all the gate lines are arranged, as shown in FIG. 6G. In order to avoid this to obtain an effect of full dot inversion, based on the embodiments mentioned above, the disclosure also provides another liquid crystal display panel and a method for driving the liquid crystal display panel.

In the liquid crystal display panel, two consecutively arranged first gate lines are present at intermediate positions within the region where all the gate lines are arranged, and first gate lines are alternately arranged line by line with second gate lines at other positions except for the intermediate positions (that is, first gate lines are alternately arranged line by line with second gate lines, except for that two consecutively arranged first gate lines are present at intermediate positions within the region where all the gate lines are arranged). For the two rows of sub-pixels respectively controlled by the two consecutively arranged first gate lines, during the scanning period for a frame of image, the polarities of the data signals provided by the data lines to one of the two rows of sub-pixels connected with the two consecutively arranged first gate lines are inverse to the polarities of the data signals provided by the data lines to the other of the two rows of sub-pixels connected with the two consecutively arranged first gate lines.

It is noted that, the above liquid crystal display panel also includes a group of first gate drivers 101 and a group of second gate drivers 102 located at left and right sides of the liquid crystal display panel, respectively. The group of first gate drivers 101 and the group of second gate drivers 102 are configured to drive the gate lines line by line in reverse directions, respectively, to control the turning on and off of TFTs in the corresponding sub-pixel units. Here, the group of first gate drivers 101 is configured to drive the group of first gate lines in a forward direction, and the group of second gate drivers 201 is configured to drive the group of second gate lines in a backward direction.

The liquid crystal display panel will be further described in detail below by taking the liquid crystal display panel having a 8×8 resolution as an example.

As shown in FIGS. 7A-7D and 10, the liquid crystal display panel includes a group of first gate drivers 101 and a group of second gate drivers 201 longitudinally disposed at both sides of the liquid crystal display panel, respectively, where the group of first gate drivers 101 includes four first gate drivers G11, G13, G15 and G17 cascadedly-connected with each other, and the group of second gate drivers 201 includes four second gate drivers G10, G12, G16 and G18 cascadedly-connected with each other.

The group of first gate lines includes first gate lines $G_{L12}$, $G_{L14}$, $G_{L15}$ and $G_{L17}$, and the group of second gate lines includes second gate lines $G_{L11}$, $G_{L13}$, $G_{L16}$ and $G_{L18}$ in the liquid crystal display panel, where two consecutively arranged first gate lines $G_{L14}$ and $G_{L15}$ are present only at intermediate positions within a region where all the gate lines are arranged, and the other first gate lines are alternately arranged line by line with the second gate lines at other positions except for the intermediate positions. As shown in FIGS. 7A-7D, in the liquid crystal display panel, the second gate line $G_{L11}$, the first gate line $G_{L12}$, the second gate line $G_{L13}$, the first gate line $G_{L14}$, the first gate line $G_{L15}$, the second gate line $G_{L16}$, the first gate line $G_{L17}$ and the second gate line $G_{L18}$ are sequentially arranged.

The first gate lines $G_{L14}$ and $G_{L16}$ consecutively arranged at the intermediate positions are respectively controlled by the adjacent first gate drivers G13 and G15 from the group of first gate drivers 101 longitudinally disposed at the left side of the display panel. In addition, the first gate lines $G_{L12}$ and $G_{L17}$ are controlled by the first gate driver G11 and the first gate driver G17 respectively.

The second gate drivers G10, G12, G16 and G18 longitudinally disposed at the right side of the display panel are connected with the second gate lines $G_{L11}$, $G_{L13}$, $G_{L16}$ and $G_{L18}$, respectively.

As shown in FIGS. 7A to 7D, as can be seen from the above connection configuration between the gate drivers and the gate lines, the first gate $G_{L14}$ and the first gate line $G_{L15}$ consecutively arranged at the intermediate positions within the region where all the gate lines are arranged (referred to as intermediate positions for short hereinafter) are both connected to the group of first gate drivers 101 at the left side of the display panel, that is, such two adjacent gate lines at the intermediate positions are connected to the same group of gate drivers. With this configuration, the case that the polarities of the fourth row of sub-pixels connected with the second gate line $G_{L4}$ at an intermediate position are same as those of the fifth row of sub-pixels connected with the first gate line $G_{L5}$ at an intermediate position (i.e., the center of the display panel) in displaying one frame of image by the liquid crystal display panel in the embodiment shown in FIG. 6G can be avoid, thereby achieving an effect of full dot inversion.

In addition, the provision of data signals, via data lines DL, to corresponding sub-pixels by column means charging the sub-pixels, polarities of the data signals provided by the adjacent data lines DL are inverse to each other, and the first gate drivers and the second gate drivers are sequentially turned on.

The specific operational time sequence of the driving circuit is shown in FIGS. 7A-7D and FIG. 10.

During the former half ($T_0$-$T_{1/2}$) of the scanning period ($T_0$-$T_1$) for one frame of image, the data signal Data provided by the data line DL is at a high level, and the polarities of the data signals provided by the two adjacent data lines DL are inverse to each other. For example, for a first data line and a second data line connected to two adjacent columns of sub-pixels, when the first data line outputs a positive data signal to a first sub-pixel in the column of sub-pixels corresponding to the first data line, the second data line outputs a negative data signal to a second sub-pixel in the column of sub-pixels corresponding to the second data line, so that the polarity of the first sub-pixel is inverse to that of the second sub-pixel adjacent to the first sub-pixel. The group of first gate drivers 101 drives gate lines in a direction inverse to a direction in which the group of second gate drivers 201 drives gate lines. For example, the group of first gate drivers 101 is configured to scan the group of first gate lines in a forward direction from top to bottom (i.e., the arrow direction at the left side of the display panel as shown in FIGS. 7A-7D), and the group of second gate drivers 201 is configured to scan the group of second gate lines in a backward direction from bottom to top (i.e., the arrow direction at the right side of the display panel as shown in FIGS. 7A-7D).

Figure 7A:
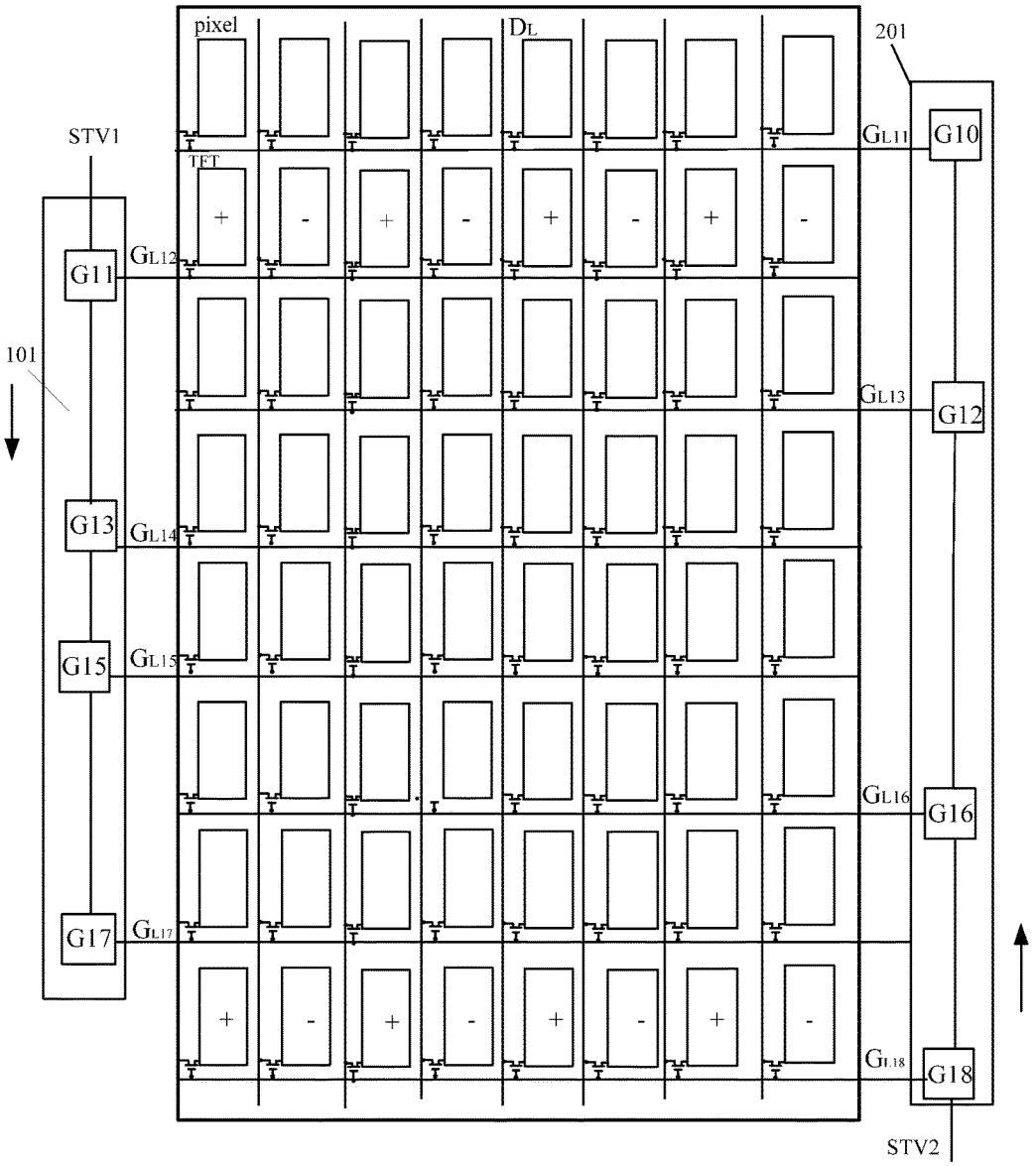
FIGS. 7A to 7D are schematic views showing polarity states of sub-pixels in different periods when one frame of image is displayed by another liquid crystal display panel having a 8×8 resolution, according to embodiments of the disclosure.
Figure 10:
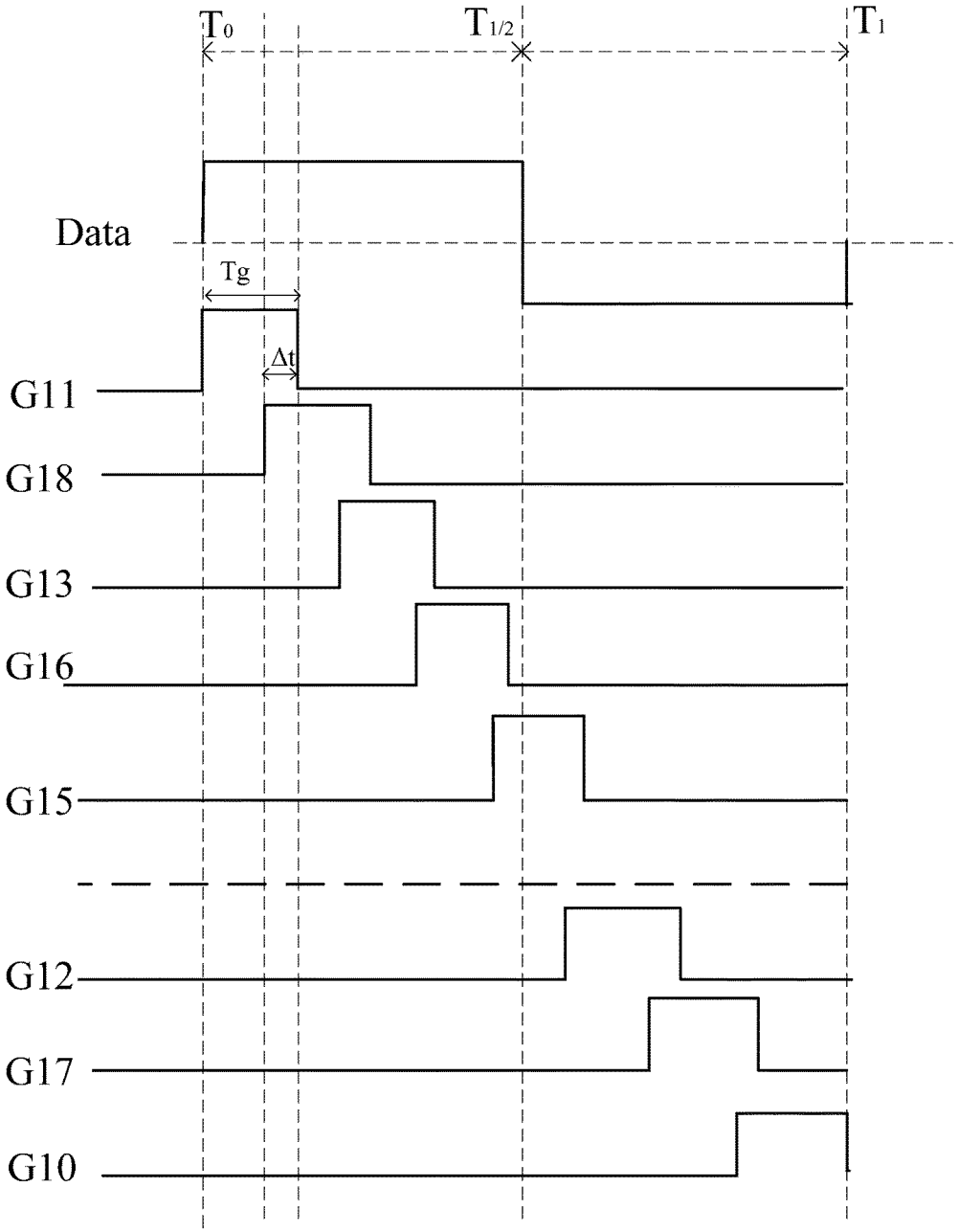
FIG. 10 is a diagram showing an operational time sequence of working states of the liquid crystal display panel shown in FIGS. 7A to 7D.

As shown in FIGS. 7A and 10, the group of first gate drivers 101 receives a first initial signal STV1, and the group of second gate drivers 201 receives a second initial signal STV2; a first gate driver G11 outputs a gate driving signal to turn on all the TFTs controlled by the first gate line $G_{L12}$, so that first data signals Data are applied to the row of sub-pixels connected with the TFTs controlled by the first gate line $G_{L12}$; thereafter, a second gate driver G18 outputs a gate driving signal to turn on all the TFTs controlled by the second gate line $G_{L18}$, so that first data signals Data are applied to the row of sub-pixels connected with the TFTs controlled by the second gate line $G_{L18}$.

Figure 7B:
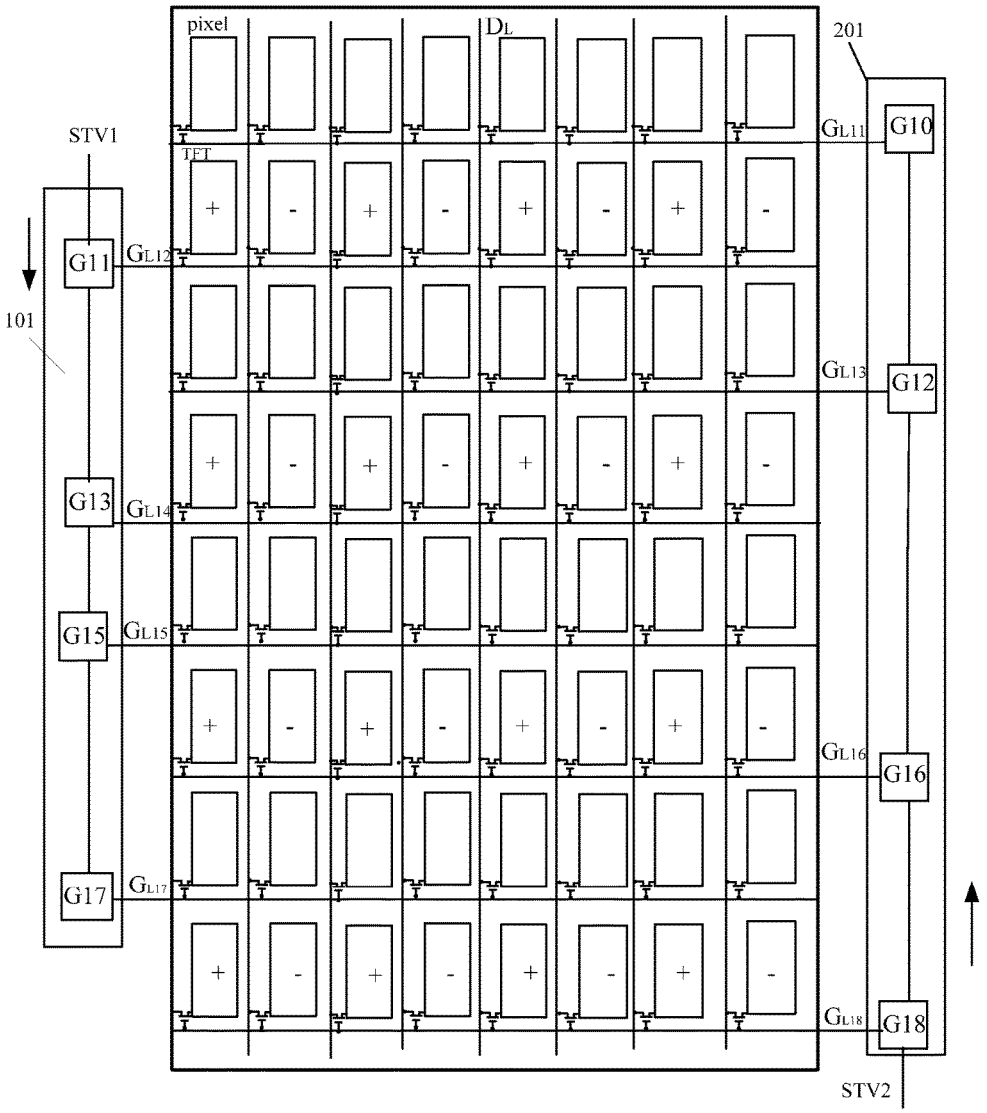

Subsequently, as shown in FIGS. 7B and 10, a first gate driver G13 outputs a gate driving signal to turn on all the TFTs controlled by the first gate line $G_{L13}$, so that first data signals Data are applied to the row of sub-pixels connected with the TFTs controlled by the first gate line $G_{L13}$; thereafter, a second gate driver G16 outputs a gate driving signal to turn on all the TFTs controlled by the second gate line $G_{L16}$, so that first data signals Data are applied to the row of sub-pixels connected with the TFTs controlled by the second gate line $G_{L16}$.

During the latter half ($T_{1/2}$-$T_1$) of the scanning period ($T_0$-$T_1$) for the frame of image, the data signals Data provided by the data lines DL, the polarities of which are inversed, are applied to the remaining sub-pixels not yet applied with the data signals, so that the polarities of the remaining sub-pixels are inverse to the polarities of the sub-pixels which were scanned during the former half ($T_0$-$T_{1/2}$) of the scanning period ($T_0$-$T_1$) for the frame of image. For example, as shown in FIG. 10, at a time point $T_{1/2}$, the polarity of the data signal provided by the data line DL is inversed, that is, the first data signal Data provided by the data line DL is changed from a positive voltage signal to a negative voltage signal, which is referred to as a second data signal Data, so that the polarity of the corresponding sub-pixel is inversed accordingly, thereby resulting in a half column inversion.

Figure 7C:
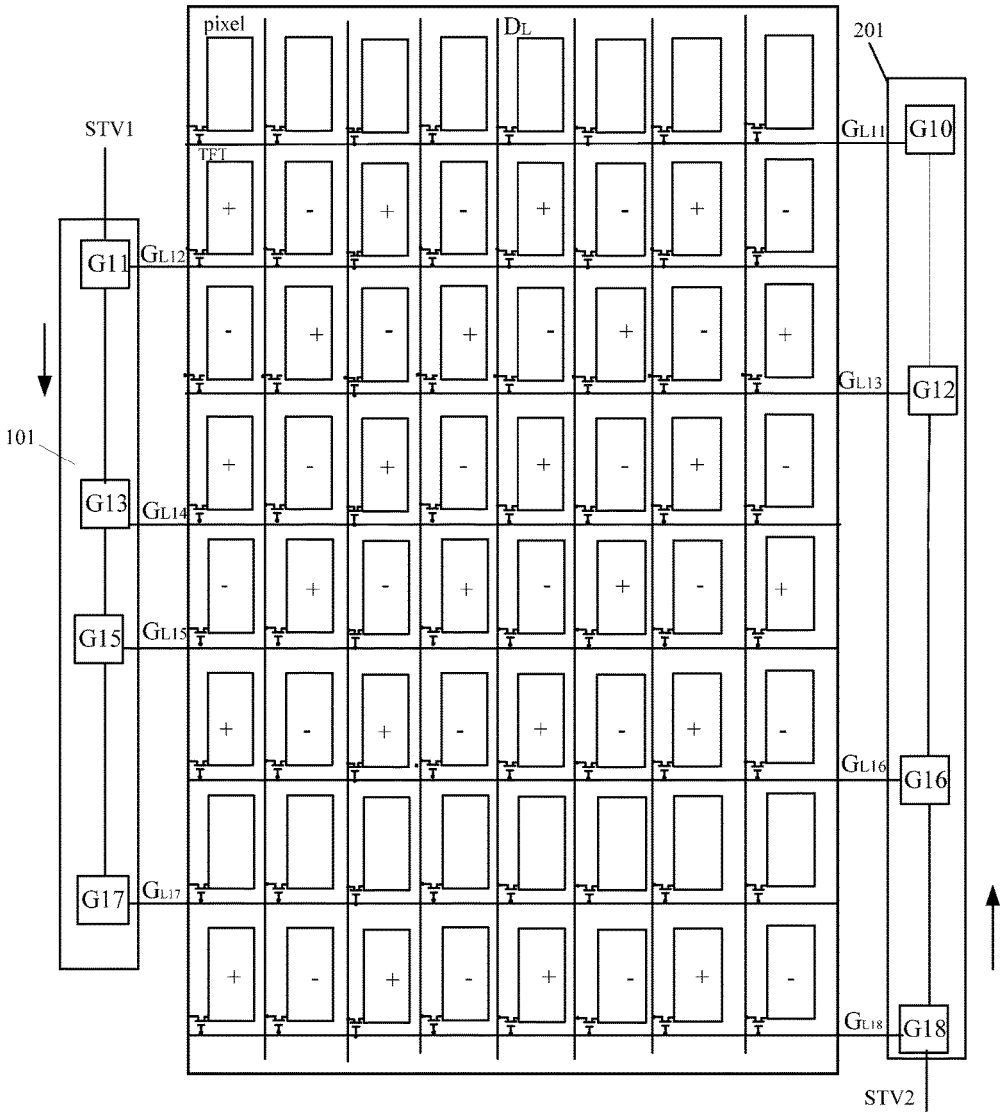

As shown in FIGS. 7C and 10, the first gate driver G15 outputs a gate driving signal to turn on all the TFTs controlled by the first gate line $G_{L15}$, so that second data signals Data are applied to the row of sub-pixels connected with the TFTs controlled by the first gate line $G_{L15}$; at this time, the polarities of the second data signals Data on the data lines DL applied to the row of sub-pixels connected with the first gate line $G_{L15}$ are inverse to polarities of the first data signals Data applied to the row of sub-pixels connected with the second gate line $G_{L16}$ which was immediately precedingly driven; thereafter, the second gate driver G12 outputs a gate driving signal to turn on all the TFTs controlled by the second gate line $G_{L12}$, so that second data signals Data are applied to the row of sub-pixels connected with the TFTs controlled by the second gate line $G_{L12}$.

Figure 7D:
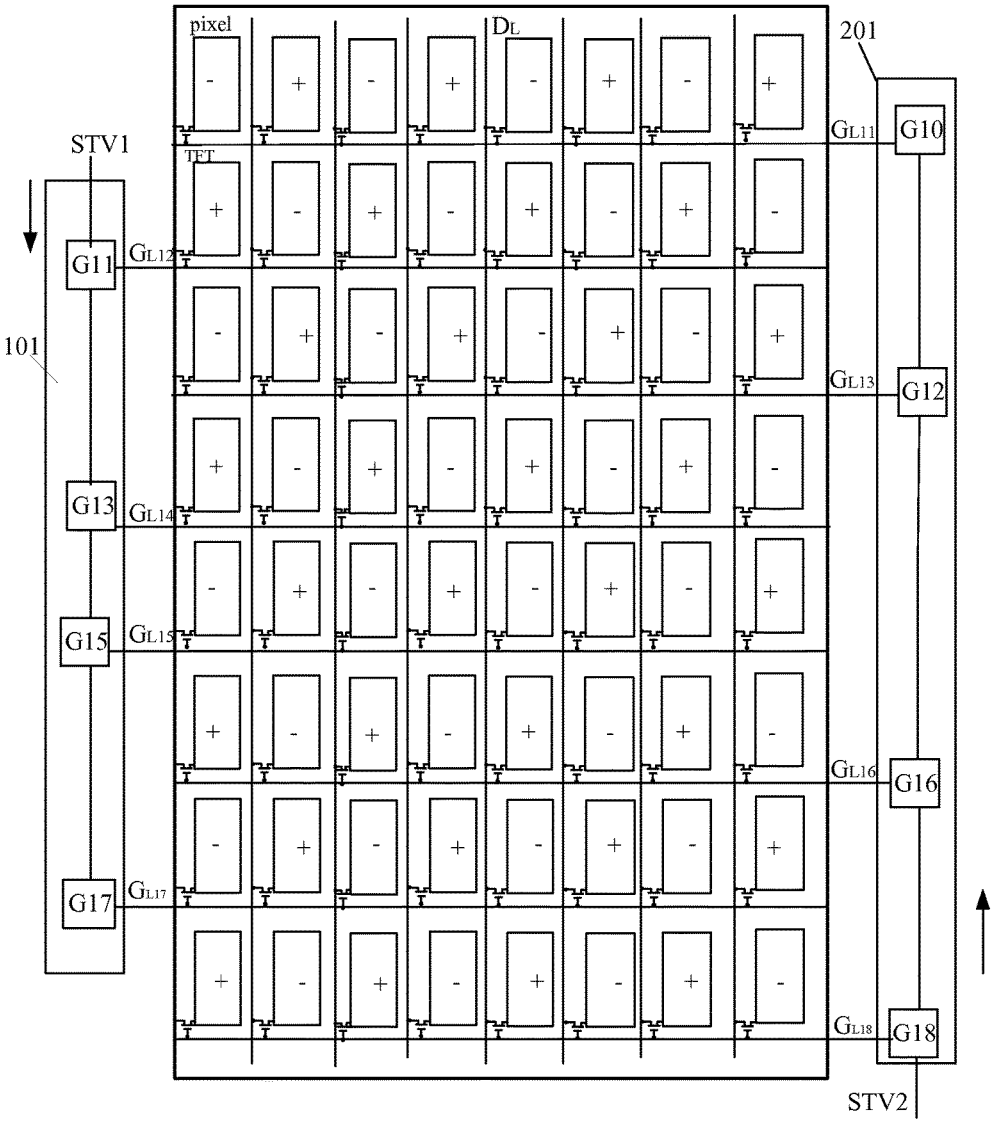

Thereafter, as shown in FIGS. 7D and 10, the first gate driver G17 outputs a gate driving signal to turn on all the TFTs controlled by the first gate line $G_{L17}$, so that second data signals Data are applied to the row of sub-pixels connected with the TFTs controlled by the first gate line $G_{L17}$; thereafter, the second gate driver $G_{L10}$ outputs a gate driving signal to turn on all the TFTs controlled by the first gate line $G_{L10}$, so that second data signals Data are applied to the row of sub-pixels connected with the TFTs controlled by the first gate line $G_{L10}$, thereby finishing a scanning and driving operation of one frame.

As known from FIG. 7D, during the scanning period ($T_0$-$T_1$) for the frame of image, the polarities of the fourth row of sub-pixels controlled by the first gate line $G_{L4}$ at an intermediate position are inverse to the polarities of the fifth row of sub-pixels controlled by the first gate line $G_{L5}$ at an intermediate position, and hence, the polarity of each sub-pixel is inverse to the polarities of its four adjacent sub-pixels which are located above, below, left and right to the sub-pixel, thereby resulting in a dot inversion driving manner, so that the optimal flicker suppressing effect and the lowered power consumption can be achieved, thereby achieving the displayed image with high quality.

Referring still to FIG. 10, since the second gate line $G_{L18}$ is driven after the first gate line $G_{L12}$ is driven and before the first gate line $G_{L12}$ is finished being driven, the driven periods of the first gate line $G_{L12}$ and the second gate line $G_{L18}$ overlap with each other, that is, the falling edge of the first driving signal $Gout_1$ output by the first gate driver G11 is later than the rising edge of the second driving signal $Gout_8$ output by the second gate driver G18 by an overlapped period Δt. During the overlapped period Δt, the data lines DL can pre-charge the sub-pixels connected with the second gate driver G18 (i.e. the sub-pixels controlled by the second gate line $G_{L18}$), thereby ensuring the pixel voltage of the row of the sub-pixels. Of course, the overlapped period Δt is less than a period Tg during which the first driving signal $Gout_1$ maintains at a high level state.

Based on the above embodiments in which two adjacent gate lines at the intermediate positions are connected to the same group of gate drivers. Unlike this, embodiments also provide another liquid crystal display panel, where two adjacent gate lines at the intermediate positions are respectively connected to different sub-groups of gate drivers, as shown in FIGS. 8A-8D and FIG. 11. The liquid crystal display panel and a driving manner thereof will be further described in detail below by taking the liquid crystal display panel having a 8×8 resolution as an example:

As shown in FIGS. 8A-8D, the liquid crystal display panel includes a group of first gate drivers and a group of second gate drivers longitudinal disposed at both sides of the liquid crystal display panel, respectively. The group of first gate drivers includes two sub-groups of gate drivers, i.e. a first sub-group of gate drivers 1001 and a third sub-group of gate drivers 1003, and a first initial signal STV1 is applied to the first sub-group of gate drivers 1001 and a third initial signal STV3 is applied to the third sub-group of gate drivers 1003. The group of second gate drivers includes two sub-groups of gate drivers, i.e. a second sub-group of gate drivers 2002 and a fourth sub-group of gate drivers 2004, and a second initial signal STV2 is applied to the second sub-group of gate drivers 2002 and a fourth initial signal STV4 is applied to the fourth sub-group of gate drivers 2004. In some embodiments, the first sub-group of gate drivers 1001 includes two first gate drivers G21 and G23 cascadedly-connected with each other, the third sub-group of gate drivers 1003 includes two first gate drivers G25 and G27 cascadedly-connected with each other; the second sub-group of gate drivers 2002 includes two second gate drivers G26 and G28 cascadedly-connected with each other; and the fourth sub-group of gate drivers 2004 includes two second gate drivers G20 and G22 cascadedly-connected with each other. It is noted that, the above embodiments are exemplary and the disclosure is not limited thereto.

Furthermore, the liquid crystal display panel also includes a group of first gate lines and a group of second gate lines. The group of first gate lines includes a group of first sub gate lines and a group of third sub gate lines, where the group of first sub gate lines includes first sub gate lines $G_{L22}$ and $G_{L24}$, and the group of third sub gate lines includes third sub gate lines $G_{L25}$ and $G_{L27}$.

The group of second gate lines includes a group of second sub gate lines and a group of fourth sub gate lines, where the group of second sub gate lines include second sub gate lines $G_{L26}$ and $G_{L28}$, and the group of fourth sub gate lines group includes fourth sub gate lines $G_{L21}$ and $G_{L23}$.

Referring still to FIGS. 8A-8D, the control relationships between the groups of gate lines and the corresponding groups of gate drivers are described below.

The first sub-group of gate drivers 1001 is configured to drive the group of first sub gate lines; the second sub-group of gate drivers 2002 is configured to drive the group of second sub gate lines; the third sub-group of gate drivers 1003 is configured to drive the group of third sub gate lines; and the first sub-group of gate drivers 1001 is configured to drive the group of fourth sub gate lines. The first sub-group of gate drivers 1001 drives gate lines in a direction same as a direction in which the third sub-group of gate drivers 1003 drives gate lines; and the second sub-group of gate drivers 2002 drives gate lines in a direction same as a direction in which the fourth sub-group of gate drivers 2004 drives gate lines.

Referring still to FIGS. 8A-8D, the arrangement of the various groups of sub gate lines on the display panel is described below.

The first sub gate lines are alternately arranged line by line with the fourth sub gate lines, that is, in the upper half of the display panel, the fourth sub gate line $G_{L21}$, the first sub gate line $G_{L22}$, the fourth sub gate line $G_{L23}$ and the first sub gate line $G_{L24}$ are sequentially arranged from top to the intermediate position; also, the second sub gate lines are alternately arranged line by line with the third sub gate lines, that is, in the lower half of the display panel, the third sub gate line $G_{L25}$, the second sub gate line $G_{L26}$, the third sub gate line $G_{L27}$ and the second sub gate line $G_{L28}$ are sequentially arranged from the intermediate position to the bottom.

Referring still to FIGS. 8A-8D, it should be noted that the first sub-group of gate drivers 1001 is arranged adjacent to the third sub-group of gate drivers 1003, and the first sub gate line $G_{L24}$ last driven by the first sub-group of gate drivers 1001 is consecutively arranged with the third sub gate line $G_{L25}$ first driven by the third sub-group of gate drivers 1003.

The above liquid crystal display panel and the driving manner thereof will be further described below. The operational time sequence of the driving circuit is shown in FIGS. 8A-8D and FIG. 11:

During the former half ($T_0$-$T_{1/2}$) of the scanning period ($T_0$-$T_1$) for the frame of image, the data signal Data provided by the data line DL is at a high level, and the polarities of the data signals provided by two adjacent data lines DL are inverse to each other. For example, for a first data line and a second data line connected to two adjacent columns of sub-pixels, when the first data line outputs a positive data signal to a first sub-pixel in the column of sub-pixels corresponding to the first data line, the second data line outputs a negative data signal to a second sub-pixel in the column of sub-pixels corresponding to the second data line, so that the polarity of the first sub-pixel is inverse to that of the second sub-pixel adjacent to the first sub-pixel. The first sub-group of gate drivers 1001 sequentially apply high level signals to the first sub gate lines; the second sub-group of gate drivers 2002 sequentially apply high level signals to the second sub gate lines; and the third sub-group of gate drivers 1003 and the fourth sub-group of gate drivers 2004 output low level signals. Here, the first sub-group of gate drivers 1001 drive the sub gate lines in a direction inverse to a direction in which the second sub-group of gate drivers 2002 drive the sub gate lines.

Figure 8A:
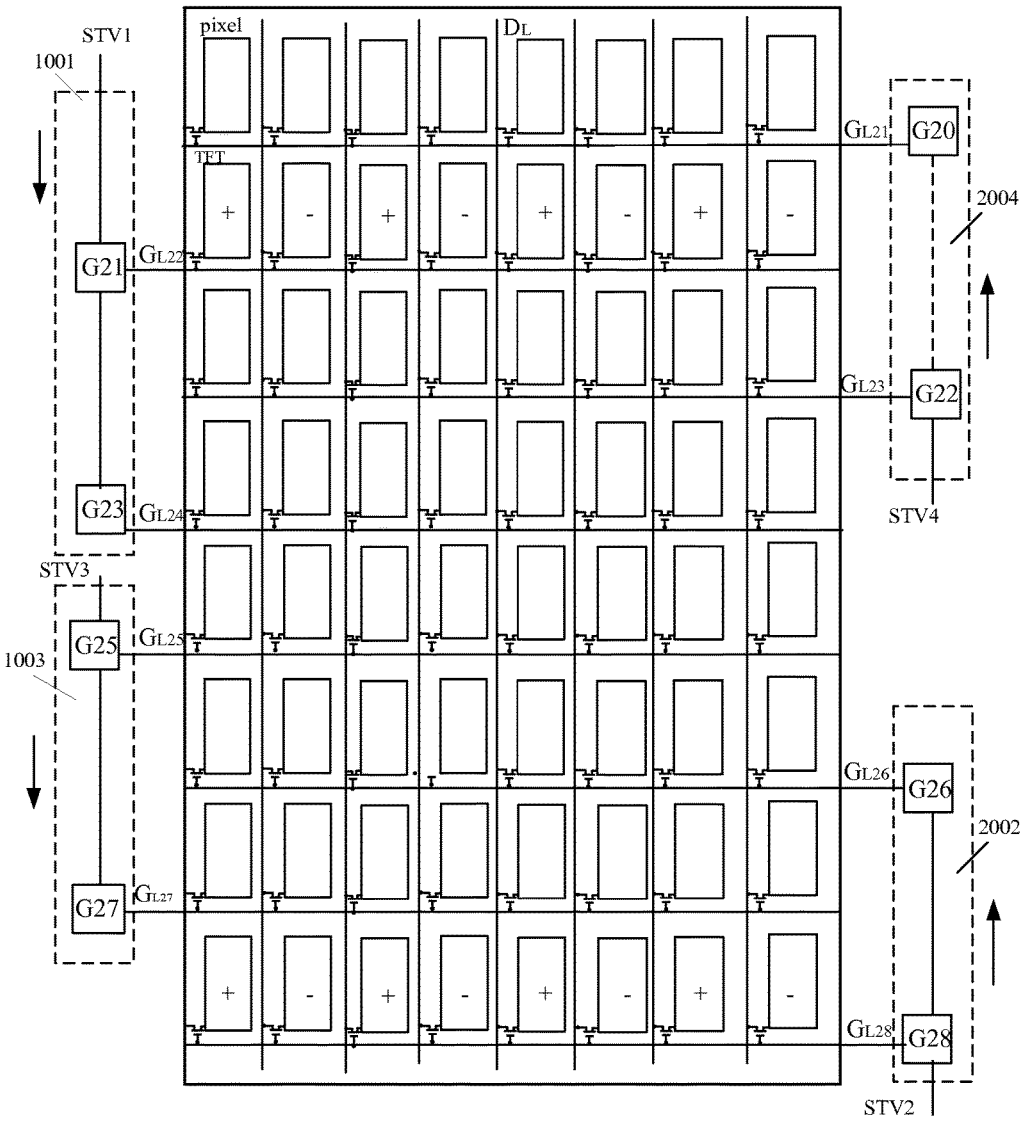
FIGS. 8A to 8D are schematic views showing polarity states of sub-pixels in different periods when one frame of image is displayed by still another liquid crystal display panel having a 8×8 resolution, according to embodiments of the disclosure.
Figure 11:
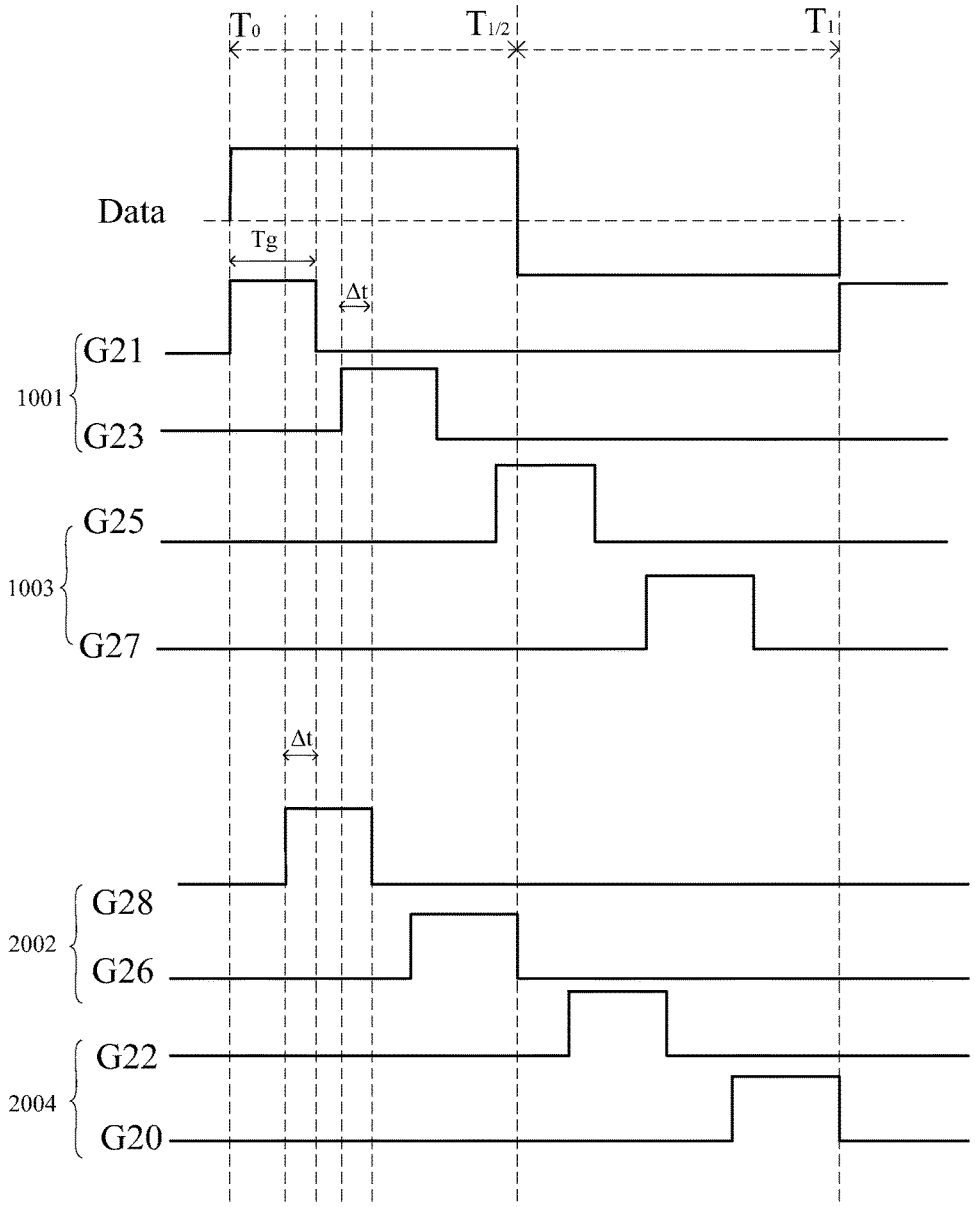
FIG. 11 is a diagram showing an operational time sequence of the liquid crystal display panel shown in FIGS. 8A to 8D.

As shown in FIGS. 8A and 11, the group of first gate drivers 1001 receives a first initial signal STV1, and the group of second gate drivers 2002 receives a second initial signal STV2; and a first gate driver G21 outputs a gate driving signal to turn on all the TFTs controlled by the first sub gate line $G_{L22}$, so that first data signals Data are applied to the row of sub-pixels connected with the TFTs controlled by the first sub gate line $G_{L22}$. Thereafter, the second gate driver G28 outputs a gate driving signal to turn on all the FTF devices controlled by the second sub gate line $G_{L28}$, so that first data signals Data are applied to the row of the sub-pixels connected with the TFTs controlled by the second sub gate line $G_{L28}$.

Figure 8B:
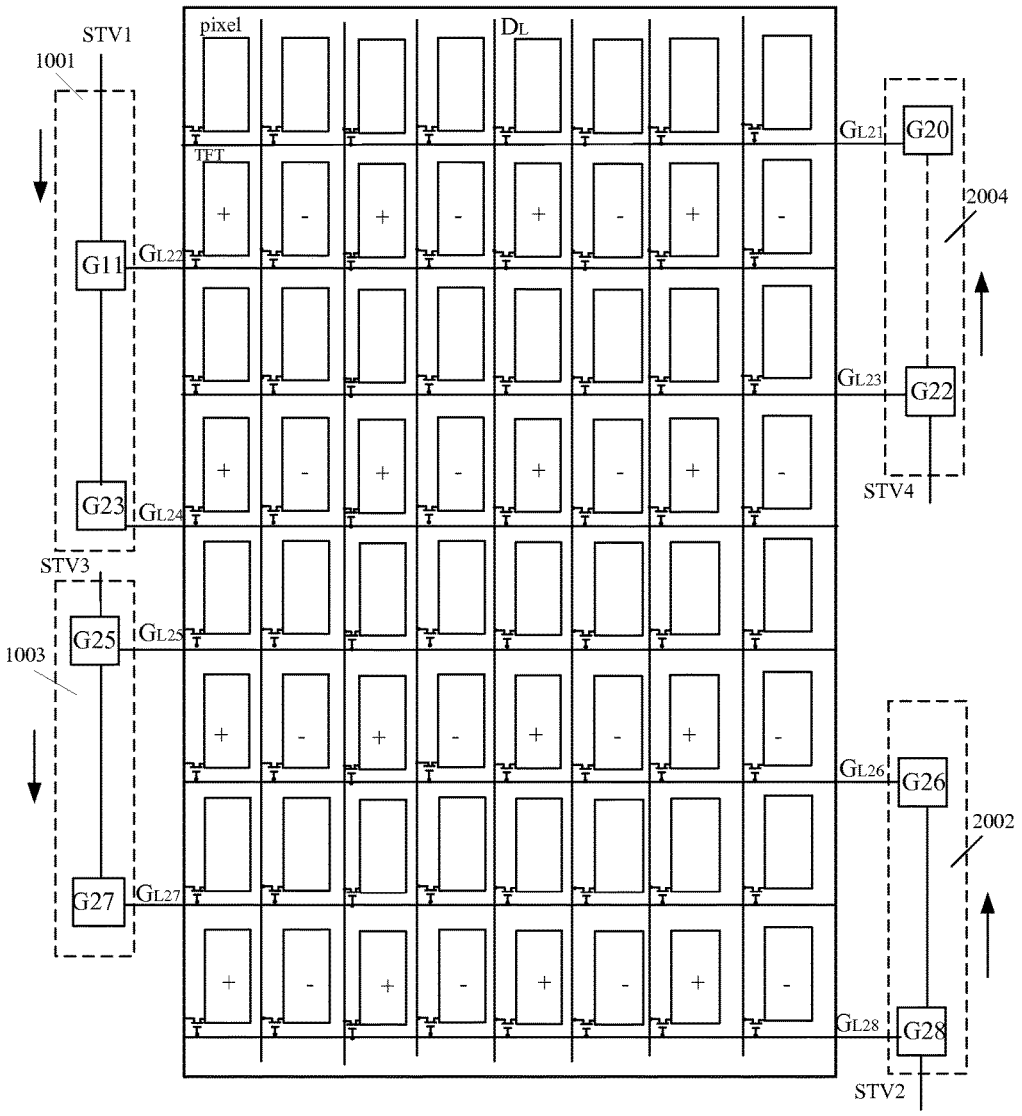

Thereafter, as shown in FIGS. 8B and 11, the first gate driver G23 outputs a gate driving signal to turn on all the FTF devices controlled by the first sub gate line $G_{L24}$, so that first data signals Data are applied to the row of sub-pixels connected with the TFTs controlled by the first sub gate line $G_{L24}$. Thereafter, the second gate driver G26 outputs a gate driving signal to turn on all the FTF devices controlled by the second sub gate line $G_{L26}$, so that first data signals Data are applied to the row of the sub-pixels connected with the TFTs controlled by the second sub gate line $G_{L26}$.

During the latter half ($T_{1/2}$-$T_1$) of the scanning period ($T_0$-$T_1$) for the frame of image, the data signals Data provided by the data lines DL, the polarities of which are inversed, are applied to the remaining sub-pixels not yet applied with the data signals, so that the polarities of the remaining sub-pixels are inverse to the polarities of the sub-pixels which were scanned during the former half ($T_0$-$T_{1/2}$) of the scanning period ($T_0$-$T_1$) for the frame of image. For example, as shown in FIG. 11, at a time point $T_{1/2}$, the polarity of the data signal provided by the data line DL is inversed, that is, the first data signal Data provided by the data line DL is changed from a positive voltage signal to a negative voltage signal, which is referred to as a second data signal Data, so that the polarity of the corresponding sub-pixel is inversed accordingly, thereby resulting in a half column inversion. Further, the first sub-group of gate drivers 1001 and the second sub-group of gate drivers 2002 output low level signals; the third sub-group of gate drivers 1003 sequentially apply high level signals to the first sub gate lines; and the fourth sub-group of gate drivers 2004 sequentially apply high level signals to the second sub gate lines, where the third sub-group of gate drivers 1003 drive the sub gate lines in a direction inverse to a direction in which the fourth sub-group of gate drivers 2004 drive the sub gate lines.

Figure 8C:
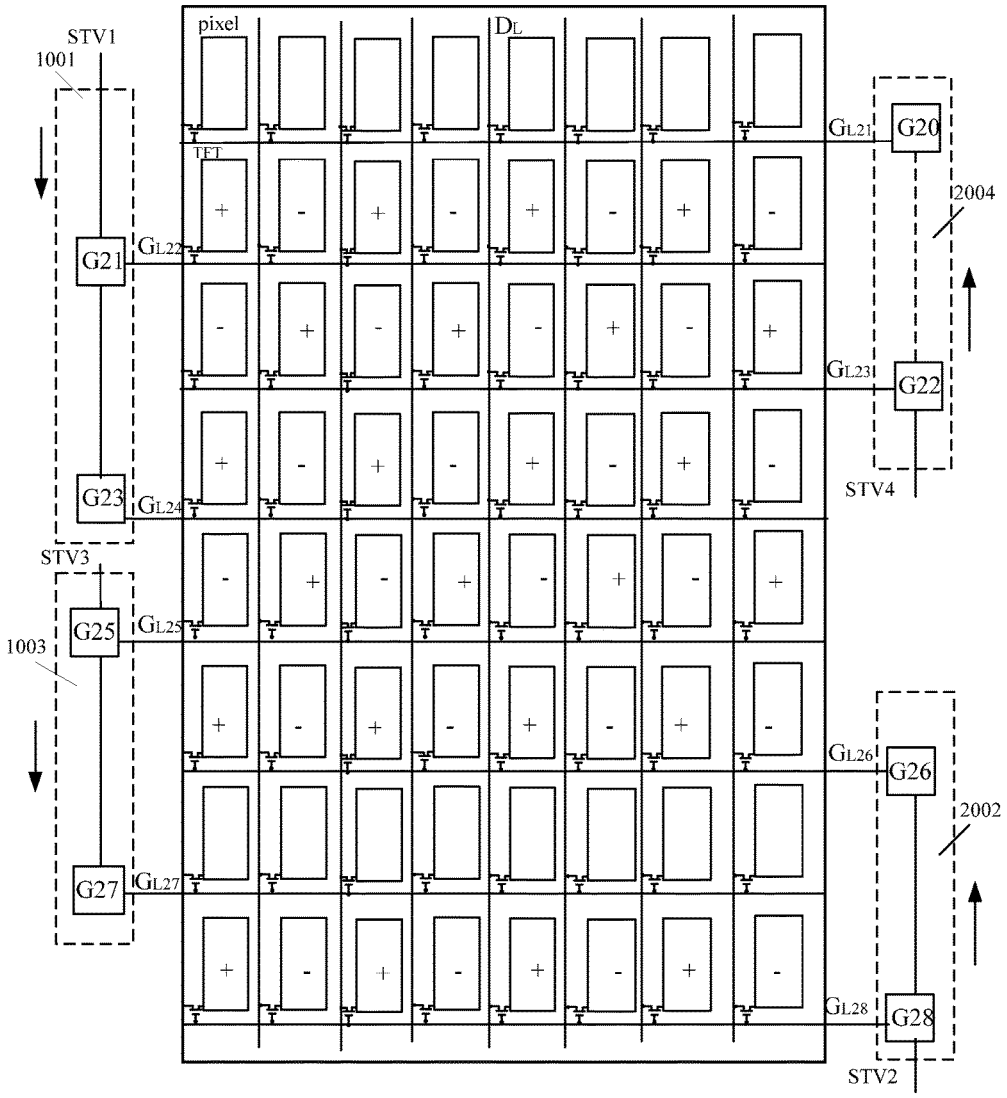

As shown in FIGS. 8C and 11, the third sub-group of gate drivers 1003 receives a third initial signal STV3, and the first gate driver G25 outputs a gate driving signal to turn on all TFTs controlled by the third sub gate line $G_{L25}$, so that second data signals Data are applied to the row of sub-pixels connected with the TFTs controlled by the third sub gate line $G_{L25}$. At this time, the polarities of the second data signals Data on the data lines DL applied to the row of sub-pixels connected with the third sub gate line $G_{L25}$ are inverse to polarities of the first data signals Data applied to the row of sub-pixels connected with the second sub gate line $G_{L26}$ which was immediately precedingly driven; thereafter, the fourth sub-group of gate drivers 2004 receives a fourth initial signal STV4; and the second gate driver G22 outputs a gate driving signal to turn on all the TFTs controlled by the fourth sub gate line $G_{L23}$, so that second data signals Data are applied to the row of sub-pixels connected with the TFTs controlled by the fourth sub gate line $G_{L23}$.

Figure 8D:
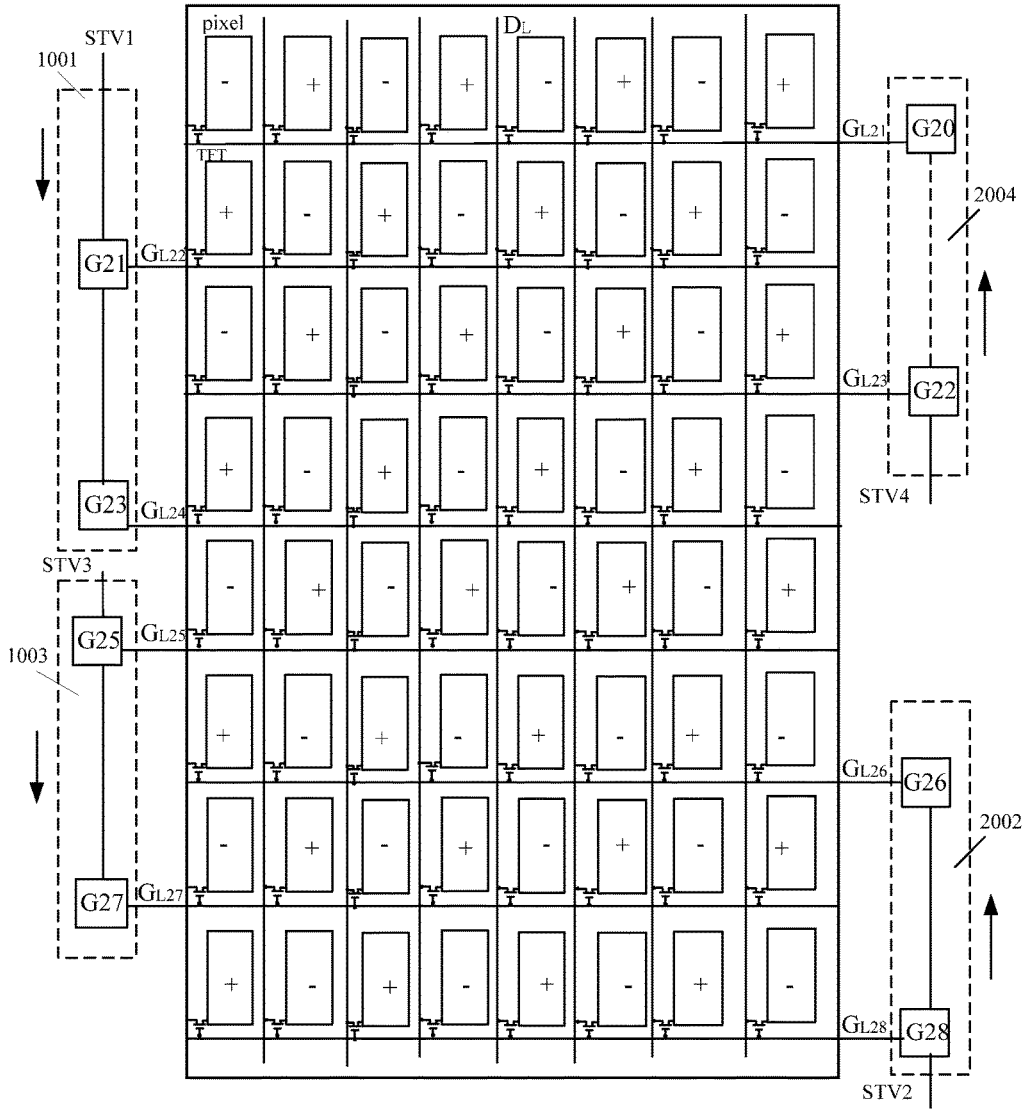

Thereafter, as shown in FIGS. 8D and 11, the first gate driver G27 outputs a gate driving signal to turn on all the TFTs controlled by the third sub gate line $G_{L27}$, so that second data signals Data are applied to the row of sub-pixels connected with the TFTs controlled by the third sub gate line $G_{L27}$; thereafter, the second gate driver G20 outputs a gate driving signal to turn on all the TFTs controlled by the fourth sub gate line $G_{L21}$, so that second data signals Data are applied to the row of sub-pixels connected with the TFTs controlled by the fourth sub gate line $G_{L21}$, thereby finishing a scanning and driving operation of one frame.

As known from FIGS. 8A-8D, the groups of gate drivers at both sides of liquid crystal display panel are divided into four separate sub-groups of gate drivers, so that the output sequence of each sub-group of gate drivers can be controlled more flexibly.

Referring still to FIG. 11, since the second sub gate line $G_{L28}$ is driven after the first sub gate line $G_{L22}$ is turned on and before the first sub gate line $G_{L22}$ is finished being driven, the driven periods of the first sub gate line $G_{L22}$ and the second sub gate line $G_{L28}$ overlap with each other, that is, the falling edge of the first driving signal $Gout_1$ output by the first gate driver G21 is later than the rising edge of the second driving signal $Gout_8$ output by the second gate driver G28 by an overlapped period Δt. During the overlapped period Δt the data lines DL can pre-charge the sub-pixels connected with the second gate driver G28 (i.e. the sub-pixels controlled by the second gate line $G_{L28}$), thereby ensuring the pixel voltage of the row of the sub-pixels. Of course, the overlapped period Δt is less than a period Tg during which the first driving signal $Gout_1$ maintains at a high level state.

Embodiments of the disclosure provide a liquid crystal display device. FIG. 12 is a schematic view showing the structure of a liquid crystal display device according to embodiments of the disclosure. Referring to FIG. 12, the liquid crystal display device 50 includes a liquid crystal display panel 51 and can further include driving circuits and other means for supporting the normal working of the liquid crystal display device 50. The liquid crystal display panel 51 may be embodied by the liquid crystal display panel described in any of the embodiments mentioned above. The above liquid crystal display device 50 can be a mobile phone, a desktop computer, a laptop computer, a tablet computer, an electronic album, an electronic paper and so on.

Each of the portions in the disclosure is described in a progressive manner, and each portion emphasizes the difference from the other portion, and the same part or the similar part in each of the portions can be referred to with each other.

The general principles in the disclosure can be realized in other embodiments without departing from the spirit and the scope of the disclosure. Therefore, the embodiments are not intended to limit the disclosure but to provide a wider scope in accordance with principles in the disclosure.

Various modifications and additions can be made to the exemplary embodiments discussed without departing from the scope of the disclosure. For example, while the embodiments described above refer to particular features, the scope of this disclosure also includes embodiments having different combinations of features and embodiments that do not include all of the described features. Accordingly, the scope of the disclosure is intended to embrace all such alternatives, modifications, and variations as fall within the scope of the claims, together with all equivalents thereof.

We claim:

1. A liquid crystal display panel, comprising:

a plurality of data lines extending along a first direction and a plurality of gate lines extending along a second direction, wherein a plurality of sub-pixels are defined by insulatedly intersecting the plurality of data lines with the plurality of gate lines, wherein each of the plurality of data lines is configured to provide a data signal to a corresponding sub-pixel by column, and polarities of the data signals provided by two adjacent data lines are inverse to each other, wherein, during a scanning period for a frame of image, the polarities of the data signals provided by the data lines in a former half of the scanning period for the frame of image are inverse to the polarities of the data signals provided by the data lines in a latter half of the scanning period for the frame of image;

the plurality of gate lines comprise a group of first gate lines comprising a plurality of first gate lines, and a group of second gate lines comprising a plurality of second gate lines, wherein at least a part of the plurality of first gate lines are alternately disposed line by line with at least a part of the plurality of second gate lines;

the liquid crystal display panel further comprises a group of first gate drivers configured to drive the group of first gate lines, and a group of second gate drivers configured to drive the group of second gate lines, wherein the group of first gate drivers drive the first gate lines in a direction inverse to a direction in which the group of second gate drivers drive the second gate lines;

two of the plurality of first gate lines are consecutively disposed at intermediate positions in a region where all the gate lines are disposed; and the remaining first gate lines are alternately disposed line by line with the plurality of second gate lines at positions except for the intermediate positions;

the two first gate lines consecutively disposed at the intermediate positions in the region where all the gate lines are disposed are respectively configured to control two adjacent rows of sub-pixels, and during the scanning period for the frame of image, the polarities of the data signals provided for one of the two adjacent rows of sub-pixels by the data lines are inversed to the polarities of the data signals provided for the other of the two adjacent rows of sub-pixels by the data lines, respectively;

the group of first gate drivers comprises a first sub-group of gate drivers and a third sub-group of gate drivers; and the group of second gate drivers comprises a second sub-group of gate drivers and a fourth sub-group of gate drivers;

the group of first gate lines comprises a group of first sub gate lines and a group of third sub gate lines, wherein the group of first sub gate lines comprises a plurality of first sub gate lines, and the group of third sub gate lines comprises a plurality of third sub gate lines; while the group of second gate lines comprises a group of second sub gate lines and a group of fourth sub gate lines, wherein the group of second sub gate lines comprises a plurality of second sub gate lines, and the group of fourth sub gate lines comprises a plurality of fourth sub gate lines; wherein the plurality of first sub gate lines are alternately disposed line by line with the plurality of fourth sub gate lines, and the plurality of second sub gate lines are alternately disposed line by line with the plurality of third sub gate lines;

the first sub-group of gate drivers is configured to drive the group of first sub gate lines;

the second sub-group of gate drivers is configured to drive the group of second sub gate lines;

the third sub-group of gate drivers is configured to drive the group of third sub gate lines;

the fourth sub-group of gate drivers is configured to drive the group of fourth sub gate lines;

the group of first sub gate lines is disposed adjacently to the group of third sub gate lines, and one of first sub gate lines that is last driven by the first sub-group of gate drivers is consecutively disposed with one of third sub gate lines that is first driven by the third sub-group of gate drivers;

the first sub-group of gate drivers drives the first sub gate lines in a direction same as a direction in which the third sub-group of gate drivers drives the third sub gate lines; and the second sub-group of gate drivers drives the second sub gate lines in a direction same as a direction in which the fourth sub-group of gate drivers drives the fourth sub gate lines; and during the former half of the scanning period for the frame of image, the first sub-group of gate drivers sequentially applies a high level signal to each of the plurality of first sub gate lines; the second sub-group of gate drivers sequentially applies the high level signal to each of the plurality of second sub gate lines; and both the third sub-group of gate drivers and the fourth sub-group of gate drivers output a low level signal; wherein the first sub-group of gate drivers drives the first sub gate lines in a direction inverse to a direction in which the second sub-group of gate drivers drives the second sub gate lines; during the latter half of the scanning period for the frame of image, the third sub-group of gate drivers sequentially applies the high level signal to each of the plurality of first sub gate lines; the fourth sub-group of gate drivers sequentially applies the high level signal to each of the plurality of second sub gate lines; and both the first sub-group of gate drivers and the second sub-group of gate drivers output the low level signal; wherein the third sub-group of gate drivers drives the third sub gate lines in a direction inverse to a direction in which the fourth sub-group of gate drivers drives the fourth sub gate lines.

2. The liquid crystal display panel of claim 1, wherein the group of first gate drivers comprises at least two first gate drivers cascadedly-connected with each other; and the group of second gate drivers comprises at least two second gate drivers cascadedly-connected with each other, wherein at least a part of the first gate drivers and a part of the second gate drivers are successively turned on.

3. The liquid crystal display panel of claim 2, wherein for the first gate driver and the second gate driver which are consecutively turned on, the first gate driver outputs a first driving signal and the second gate driver outputs a second driving signal, wherein a period during which the first driving signal maintains at a high level state overlaps with a period during which the second driving signal maintains at the high level state for an overlapped period ($\Delta t$) which is less than the period (Tg) during which the first driving signal maintains at the high level state.

4. The liquid crystal display panel of claim 3, wherein during the overlapped period ($\Delta t$), the data lines provide the data signals to the sub-pixels connected with the second gate driver.

5. The liquid crystal display panel of claim 1, wherein all the first gate drivers and the second gate drivers are successively turned on.

6. A liquid crystal display device, comprising a liquid crystal panel, wherein the liquid crystal panel comprises:

a plurality of data lines extending along a first direction and a plurality of gate lines extending along a second direction, wherein a plurality of sub-pixels are defined by insulatedly intersecting the plurality of data lines with the plurality of gate lines, wherein each of the plurality of data lines is configured to provide a data signal to a corresponding sub-pixel by column, and polarities of the data signals provided by two adjacent data lines are inverse to each other, wherein, during a scanning period for a frame of image, the polarities of the data signals provided by the data lines in a former half of the scanning period for the frame of image are inverse to the polarities of the data signals provided by the data lines in a latter half of the scanning period for the frame of image;

the plurality of gate lines comprise: a group of first gate lines comprising a plurality of first gate lines, and a group of second gate lines comprising a plurality of second gate lines, wherein at least a part of the plurality of first gate lines are alternately disposed line by line with at least a part of the plurality of second gate lines;

the liquid crystal display panel further comprises: a group of first gate drivers configured to drive the group of first gate lines, and a group of second gate drivers configured to drive the group of second gate lines, wherein the group of first gate drivers drives the first gate lines in a direction inverse to a direction in which the group of second gate drivers drive the second gate lines;

two of the plurality of first gate lines are consecutively disposed at intermediate positions in a region where all the gate lines are disposed; and the remaining first gate lines are alternately disposed line by line with the plurality of second gate lines at positions except for the intermediate positions;

the two first gate lines consecutively disposed at the intermediate positions in the region where all the gate lines are disposed are respectively configured to control two adjacent rows of sub-pixels, and during the scanning period for the frame of image, the polarities of the data signals provided for one of the two adjacent rows of sub-pixels by the data lines are inversed to the polarities of the data signals provided for the other of the two adjacent rows of sub-pixels by the data lines, respectively;

the group of first gate drivers comprises a first sub-group of gate drivers and a third sub-group of gate drivers; and the group of second gate drivers comprises a second sub-group of gate drivers and a fourth sub-group of gate drivers;

the group of first gate lines comprises a group of first sub gate lines and a group of third sub gate lines, wherein the group of first sub gate lines comprises a plurality of first sub gate lines, and the group of third sub gate lines comprises a plurality of third sub gate lines; while the group of second gate lines comprises a group of second sub gate lines and a group of fourth sub gate lines, wherein the group of second sub gate lines comprises a plurality of second sub gate lines, and the group of fourth sub gate lines comprises a plurality of fourth sub gate lines; wherein the plurality of first sub gate lines are alternately disposed line by line with the plurality of fourth sub gate lines, and the plurality of second sub gate lines are alternately disposed line by line with the plurality of third sub gate lines;

the first sub-group of gate drivers is configured to drive the group of first sub gate lines;

the second sub-group of gate drivers is configured to drive the group of second sub gate lines;

the third sub-group of gate drivers is configured to drive the group of third sub gate lines;

the fourth sub-group of gate drivers is configured to drive the group of fourth sub gate lines;

the group of first sub gate lines is disposed adjacently to the group of third sub gate lines, and one of first sub gate lines that is last driven by the first sub-group of gate drivers is consecutively disposed with one of third sub gate lines that is first driven by the third sub-group of gate drivers;

the first sub-group of gate drivers drives the first sub gate lines in a direction same as a direction in which the third sub-group of gate drivers drives the third sub gate lines; and the second sub-group of gate drivers drives the second sub gate lines in a direction same as a direction in which the fourth sub-group of gate drivers drives the fourth sub gate lines; and during the former half of the scanning period for the frame of image, the first sub-group of gate drivers sequentially applies a high level signal to each of the plurality of first sub gate lines; the second sub-group of gate drivers sequentially applies the high level signal to each of the plurality of second sub gate lines; and both the third sub-group of gate drivers and the fourth sub-group of gate drivers output a low level signal; wherein the first sub-group of gate drivers drives the first sub gate lines in a direction inverse to a direction in which the second sub-group of gate drivers drives the second sub gate lines; during the latter half of the scanning period for the frame of image, the third sub-group of gate drivers sequentially applies the high level signal to each of the plurality of first sub gate lines; the fourth sub-group of gate drivers sequentially applies the high level signal to each of the plurality of second sub gate lines; and both the first sub-group of gate drivers and the second sub-group of gate drivers output the low level signal; wherein the third sub-group of gate drivers drives the third sub gate lines in a direction inverse to a direction in which the fourth sub-group of gate drivers drives the fourth sub gate lines.

7. The liquid crystal display device of claim 6, wherein the group of first gate drivers comprises at least two first gate drivers cascadedly-connected with each other; and the group of second gate drivers comprises at least two second gate drivers cascadedly-connected with each other, wherein at least a part of the first gate drivers and a part of the second gate drivers are successively turned on.

8. The liquid crystal display device of claim 7, wherein for the first gate driver and the second gate driver which are consecutively turned on, the first gate driver outputs a first driving signal and the second gate driver outputs a second driving signal, wherein a period during which the first driving signal maintains at a high level state overlaps with a period during which the second driving signal maintains at the high level state for an overlapped period ($\Delta t$) which is less than the period (Tg) during which the first driving signal maintains at the high level state.

9. The liquid crystal display device of claim 8, wherein during the overlapped period ($\Delta t$), the data lines provide the data signals to the sub-pixels connected with the second gate driver.

* * * * *